US008042900B2

(12) United States Patent
Tatsumi

(10) Patent No.: US 8,042,900 B2
(45) Date of Patent: Oct. 25, 2011

(54) INKJET RECORDING APPARATUS AND INKJET RECORDING METHOD

(75) Inventor: Setsuji Tatsumi, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 442 days.

(21) Appl. No.: 12/407,934

(22) Filed: Mar. 20, 2009

(65) Prior Publication Data

US 2009/0237430 A1 Sep. 24, 2009

(30) Foreign Application Priority Data

Mar. 21, 2008 (JP) ..... 2008-074050

(51) Int. Cl.
*B41J 29/38* (2006.01)
*B41J 29/393* (2006.01)
*B41J 2/17* (2006.01)

(52) U.S. Cl. ..... 347/14; 347/19; 347/96; 347/98; 347/43

(58) Field of Classification Search ..... 347/96, 347/98, 14, 19, 43
See application file for complete search history.

(56) References Cited

U.S. PATENT DOCUMENTS 5,276,459 A 1/1994 Danzuka et al.
6,206,516 B1 3/2001 Moriyama et al.
2002/0039129 A1 4/2002 Moriyama et al.
2006/0066653 A1* 3/2006 Konno ..... 347/14
2006/0197787 A1* 9/2006 Kusunoki et al. ..... 347/6
2007/0064077 A1* 3/2007 Konno ..... 347/102

FOREIGN PATENT DOCUMENTS

JP 4-18363 A 1/1992
JP 8-39795 A 2/1996

* cited by examiner

*Primary Examiner* — Julian Huffman
(74) *Attorney, Agent, or Firm* — Birch, Stewart, Kolasch & Birch, LLP

(57) ABSTRACT

An inkjet recording apparatus includes: a treatment liquid deposition device which deposits on a recording medium a treatment liquid that insolubilizes or aggregates an ink; a recording head having nozzles which eject the ink; a non-uniformity correction amount storage device storing non-uniformity correction amount data which are prepared with respect to each of the plurality of nozzles and determined according to ejection characteristics of each of the plurality of nozzles; a data acquisition device which acquires density data of an image; a non-uniformity correction amount revision device which revises the non-uniformity correction amount data according to the density data related to another nozzle which ejects the ink that overlaps on the recording medium with the ink ejected by each of the plurality of nozzles, in such a manner that the non-uniformity correction amount data are determined; a non-uniformity correction device which corrects the density data according to the non-uniformity correction amount data; and an image forming device which controls the recording head according to the density data in such a manner that the image is formed on the recording medium.

16 Claims, 17 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method, and more particularly to an inkjet recording apparatus and an inkjet recording method of recording an image on a print medium by means of an inkjet recording head having a plurality of image recording elements.

2. Description of the Related Art

Japanese Patent Application Publication No. 4-18363 discloses an image forming apparatus having an inkjet recording head in which a plurality of recording elements are arranged, wherein a test pattern of a single color (density patch) in which the density changes in a stepwise fashion is formed on a recording medium, the densities corresponding to the positions of the ejection ports of the respective recording elements are read in by reading in the test pattern by means of a CCD line sensor, and density non-uniformities are corrected by correcting the drive conditions of the recording elements on the basis of the density data thus acquired. According to Japanese Patent Application Publication No. 4-18363, the density non-uniformity is measured respectively in each density region of the test pattern and therefore it is possible to correct density non-uniformities with high accuracy, in the whole density range.

Japanese Patent Application Publication No. 8-39795 discloses an inkjet recording method comprising a step of ejecting ink onto the recording medium and a step of ejecting a recording characteristics enhancing liquid which insolubilizes or aggregates the coloring material in the ink. Japanese Patent Application Publication No. 8-39795 discloses making, for recording primary colors (yellow, magenta, cyan or black) and secondary colors (red, green or blue), the ejection volume (the ejection volume per unit surface area on the recording medium) of the recording properties enhancing liquid ejected when recording secondary colors greater than the ejection volume of the recording properties enhancing liquid ejected when recording primary colors, in such a manner that a uniform chemical reaction between the ink and the recording properties enhancing liquid is achieved.

In an inkjet recording apparatus which records images on a recording medium (hereinafter, called "recording paper") by means of an inkjet recording head having a plurality of image recording elements, non-uniformity correction is carried out using treatment liquid which insolubilizes or aggregates the coloring material in the ink.

In the inkjet recording apparatus described above, if the ink dots formed by droplets ejected from a plurality of nozzles are overlapping on the recording paper, then although sufficient treatment liquid is supplied for a dot ejected from a preceding nozzle, the supply of treatment liquid for a dot ejected from a succeeding nozzle is not sufficient. Consequently, the preceding dots are aggregated by the treatment liquid and their dot size is reduced, whereas the succeeding dots undergo insufficient aggregation and their dot size is large. If the ink ejected from a preceding nozzle and the ink ejected from a succeeding nozzle have different colors, for example, if cyan (C) ink and magenta (M) ink are ejected respectively from a preceding nozzle and a succeeding nozzle so as to print a blue (B) region, then the previously ejected droplet C is aggregated sufficiently by the treatment liquid, and therefore the dot size is always small. On the other hand, since the treatment liquid has been consumed by the previously ejected droplet C, then the aggregation of the subsequently ejected droplet M is insufficient. Consequently, the subsequently ejected droplet M has a large dot size in comparison with a case where only a droplet of the color M is ejected.

If the dot size varies as described above, then the visibility of non-uniformity also varies. The larger the dot size, the less visible non-uniformities become.

FIG. 17 is a diagram illustrating a schematic view of examples of density non-uniformities.

In FIG. 17, reference numeral 300 indicates a line head, and reference numerals 302-1, . . . , 302-8 indicate nozzles. Reference numerals 304-1, . . . , 304-8 indicate dots formed by droplets ejected respectively by the nozzles 302-1, . . . , 302-8. Furthermore, arrow S indicates the direction of relative conveyance of the recording paper with respect to the line head 300 (namely, the sub-scanning direction).

In the example illustrated in the "(a)" part of FIG. 17, an ejection defect occurs in the nozzle 302-5 and the liquid droplet volume is smaller than the originally intended liquid droplet volume. Consequently, the size of the dots 304-5 is smaller than the dots in other columns. Moreover, the depositing positions of the dots 304-5 are displaced toward the right in the diagram from the originally intended depositing positions 306-5. Therefore, a stripe-shaped non-uniformity (banding) occurs at the position of the dots 304-5.

However, as illustrated in the "(b)" part of FIG. 17, if sufficient treatment liquid is not supplied (for example, when printing a secondary color), then the dot size becomes larger. Therefore, the overlap with the dots of the adjacent nozzles becomes greater, and the banding becomes more readily visible.

Consequently, the dot size varies and the visibility of non-uniformity changes between a case where non-uniformity is measured using a test pattern of a single color and an actual printing operation which includes secondary colors and tertiary colors. Therefore, it is not possible to respond to variation in the dot size during actual printing, by means of non-uniformity correction based on the measurement results of non-uniformity obtained using a test pattern of a single color.

Japanese Patent Application Publication No. 4-18363 measures density non-uniformity using a test pattern of a single color, and does not contemplate the relationship between preceding and succeeding nozzles when printing secondary colors or tertiary colors. Consequently, in Japanese Patent Application Publication No. 4-18363, the appearance of non-uniformity when printing secondary colors and tertiary colors differs from the measurement of non-uniformity using a test pattern, and therefore the accuracy of non-uniformity correction declines.

Japanese Patent Application Publication No. 8-39795 makes the ejection volume of a recording properties enhancing liquid when recording of a secondary color greater than when recording a primary color, but since the amount of solvent increases when recording a secondary color, then problems of cockling and curling occur. Furthermore, if the recording properties enhancing liquid is applied to recording paper by using a roller, then it is not possible to change the application volume of the recording properties enhancing liquid between a region where a primary color is to be recorded and a region where a secondary color and a tertiary color are to be recorded. Therefore, the concept of Japanese Patent Application Publication No. 8-39795 cannot be applied to such cases. Furthermore, problems of cockling and curling occur if the application volume of recording properties enhancing liquid is increased over the whole surface of the recording paper. Moreover, in the case of a recording paper having low permeability, there may be problems such as the occurrence of movement of the ink due to the recording properties enhancing liquid and increase in the drying load.

SUMMARY OF THE INVENTION

The present invention has been contrived in view of the aforementioned circumstances, an object thereof being to provide an inkjet recording apparatus and an inkjet recording method whereby non-uniformity correction can be carried out appropriately by taking account of the consumption of treatment liquid by the respective dots, when ink droplets (dots) ejected from a plurality of nozzles overlap with each other on the recording paper.

In order to attain an object described above, one aspect of the present invention is directed to an inkjet recording apparatus, comprising: a treatment liquid deposition device which deposits on a recording medium a treatment liquid that insolubilizes or aggregates an ink; a recording head having a plurality of nozzles which eject the ink on the recording medium; a non-uniformity correction amount storage device storing non-uniformity correction amount data which are prepared with respect to each of the plurality of nozzles and determined according to ejection characteristics of each of the plurality of nozzles; a data acquisition device which acquires density data of an image; a non-uniformity correction amount revision device which revises the non-uniformity correction amount data for each of the plurality of nozzles, according to the density data related to another nozzle of the plurality of nozzles which ejects the ink that overlaps on the recording medium with the ink ejected by each of the plurality of nozzles, in such a manner that the non-uniformity correction amount data with respect to each of the plurality of nozzles are determined; a non-uniformity correction device which corrects the density data according to the non-uniformity correction amount data revised by the non-uniformity correction amount revision device; and an image forming device which controls the recording head according to the density data corrected by the non-uniformity correction device in such a manner that the image is formed on the recording medium.

According to this aspect of the invention, if the ink droplets (dots) ejected by a plurality of nozzles are mutually overlapping on the recording paper, then accurate non-uniformity correction can be performed by adjusting the extent of non-uniformity correction in accordance with the density data of another nozzle which performs overlapping droplet ejection.

Desirably, the treatment liquid deposition device deposits the treatment liquid on the recording medium before the image is formed on the recording medium.

Desirably, the image forming device converts the density data corrected by the non-uniformity correction device into dot data for the plurality of nozzles of the recording head, and controls the recording head according to the dot data in such a manner that the image is formed on the recording medium.

Desirably, the non-uniformity correction amount revision device revises the non-uniformity correction amount data for a target nozzle of the plurality of nozzles, according to the density data for another nozzle of the plurality of nozzles which performs ink ejection prior to the target nozzle and ejects the ink that overlaps on the recording medium with the ink ejected by the target nozzle.

Desirably, the inkjet recording apparatus comprises a plurality of recording heads, wherein the non-uniformity correction amount revision device revises the non-uniformity correction amount data for a target recording head of the plurality of recording heads, according to the density data for another recording head of the plurality of recording heads which performs ink ejection prior to the target recording head and ejects the ink that overlaps on the recording medium with the ink ejected by the target recording head.

Desirably, the non-uniformity correction amount revision device revises the non-uniformity correction amount data in such a manner that an extent of non-uniformity correction of the target recording head becomes less as total volume of the ink ejected by the another recording head becomes greater.

According to this aspect of the invention, if the ink dots ejected by a plurality of nozzles are mutually overlapping on the recording paper, then accurate non-uniformity correction can be performed by reducing the extent of non-uniformity correction in accordance with the total volume of ink droplets ejected previously.

Desirably, the non-uniformity correction amount revision device revises the non-uniformity correction amount data in such a manner that an absolute value of a non-uniformity correction amount based on the non-uniformity correction amount data for the target recording head is reduced as total volume of the ink ejected by the another recording head becomes greater.

According to this aspect of the invention, if the ink dots ejected by a plurality of nozzles are mutually overlapping on the recording paper, then accurate non-uniformity correction can be performed by making the absolute value of the non-uniformity correction amount smaller, in accordance with the total volume of ink droplets ejected previously.

Desirably, the inkjet recording apparatus comprises: a test chart output device which causes the image forming device to form a test chart of a single color on the recording medium; a test chart reading device which reads an image of the test chart on the recording medium; and a non-uniformity correction amount calculation device which determines the ejection characteristics when the ink is ejected by each of the plurality of nozzles, according to the image of the test chart read by the test chart reading device, and determines the non-uniformity correction amount data according to the ejection characteristics.

In order to attain an object described above, another aspect of the present invention is directed to an inkjet recording method comprising the steps of: depositing a treatment liquid that insolubilizes or aggregates an ink on a recording medium; acquiring density data of an image; storing a non-uniformity correction amount data which are stored with respect to each of a plurality of nozzles of a recording head and determined according to ejection characteristics of each of the plurality of nozzles; revising the non-uniformity correction amount data for each of the plurality of nozzles, according to the density data related to another nozzle of the plurality of nozzles which ejects the ink that overlaps on the recording medium with the ink ejected by each of the plurality of nozzles, in such a manner that the non-uniformity correction amount data with respect to each of the plurality of nozzles are determined; correcting the density data according to the revised non-uniformity correction amount data; and controlling the recording head according to the corrected density data so as to form an image on the recording medium.

Desirably, the treatment liquid is deposited on the recording medium before forming the image on the recording medium.

Desirably, the corrected density data is converted into dot data for the plurality of nozzles of the recording head, and the image is formed on the recording medium by controlling the recording head according to the dot data.

Desirably, the non-uniformity correction amount data for a target nozzle of the plurality of nozzles are revised according to the density data for another nozzle of the plurality of nozzles which performs ink ejection prior to the target nozzle and ejects the ink that overlaps on the recording medium with the ink ejected by the target nozzle.

Desirably, the non-uniformity correction amount data for a target recording head of a plurality of recording heads are revised, according to the density data for another recording head of the plurality of recording heads which performs ink ejection prior to the target recording head and ejects the ink that overlaps on the recording medium with the ink ejected by the target recording head.

Desirably, the non-uniformity correction amount data are revised in such a manner that an extent of non-uniformity correction of the target recording head becomes less as total volume of the ink ejected by the another recording head becomes greater.

Desirably, the non-uniformity correction amount data are revised in such a manner that an absolute value of a non-uniformity correction amount based on the non-uniformity correction amount data for the target recording head is reduced as total volume of the ink ejected by the another recording head becomes greater.

Desirably, a test chart of a single color is formed on the recording medium, an image of the test chart on the recording medium is read, and the ejection characteristics when the ink is ejected by each of the plurality of nozzles are determined according to the read image of the test chart, and the non-uniformity correction amount data is calculated according to the ejection characteristics.

According to the present invention, if ink droplets (dots) ejected from a plurality of nozzles overlap with each other on recording paper, then it is possible to perform accurate non-uniformity correction by adjusting the extent of the insolubilization or aggregation of subsequently ejected inks by reducing the extent of non-uniformity correction in accordance with the total volume of ink droplets ejected previously.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Composition of Inkjet Recording Apparatus

Figure 1:
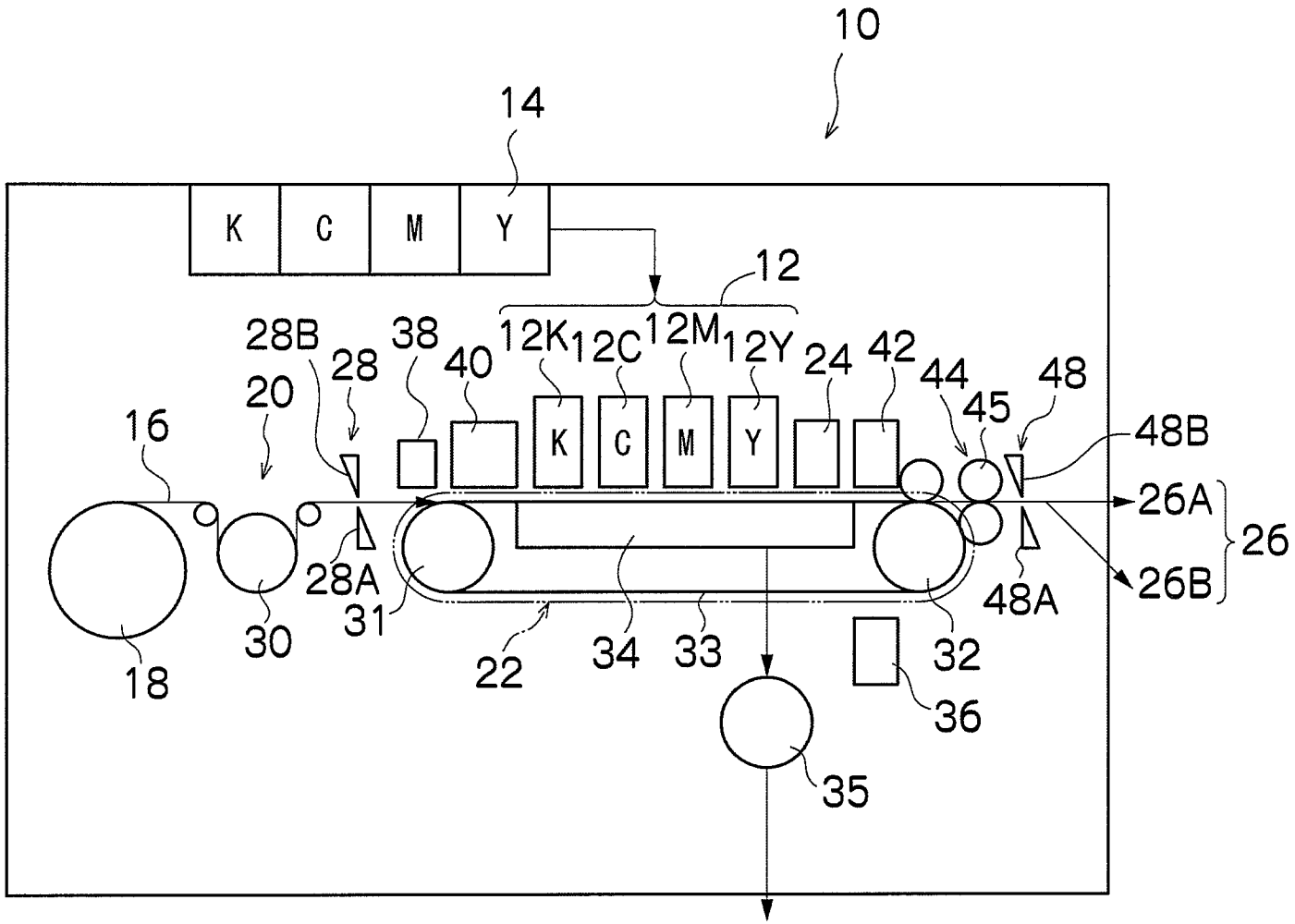
FIG. 1 is a general schematic drawing of an inkjet recording apparatus relating to one embodiment of the present invention.

FIG. 1 is a block diagram illustrating the general composition of an inkjet recording apparatus 10 relating to one embodiment of the present invention.

As illustrated in FIG. 1, the inkjet recording apparatus 10 according to the present embodiment comprises: a print unit 12 having a plurality of inkjet heads 12K, 12C, 12M, and 12Y provided for each ink color; an ink storing and loading unit 14 for storing inks of K, C, M and Y to be supplied to the print heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous recording paper) is illustrated as an example of the paper supply unit 18; however, more magazines with paper differences such as paper width and quality may be jointly provided. Moreover, recording papers may be supplied with cassettes that contain cut papers loaded in layers and that are used jointly or in lieu of the magazine for rolled paper.

In the case of a configuration in which a plurality of types of recording paper can be used, it is desirable that an information recording medium such as a bar code and a wireless tag containing information about the type of paper is attached to the magazine, and by reading the information contained in the information recording medium with a predetermined reading device, the type of recording paper to be used is automatically determined, and ink-droplet ejection is controlled so that the ink-droplets are ejected in an appropriate manner in accordance with the type of recording paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is desirably controlled so that the recording paper 16 has a curl in which the surface on which the print is to be made is slightly round outward.

As illustrated in FIG. 1, the inkjet recording apparatus 10 relating to the present embodiment comprises a cutter (first cutter) 28. The cutter 28 according to the present embodiment comprises a stationary blade 28A having a length equal to or exceeding the width of the conveyance path of the recording paper 16, and a circular blade 28B which moves along the stationary blade 24A. The stationary blade 28A is provided on the rear side of the printing surface and the circular blade 28B is disposed on the front side of printing surface, across the conveyance path from same. The recording paper (rolled paper) 16 is cut to a prescribed size by means of this cutter 28. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a horizontal plane (flat plane).

The belt 33 has a width that is greater than the width of the recording paper 16, and a plurality of suction apertures (not illustrated) are formed on the belt surface. A suction chamber 34 is disposed in a position facing the sensor surface of the print determination unit 24 and the nozzle surface of the print unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (referenced as 88 in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not illustrated, examples thereof include a configuration of nipping with, for example, a brush roller and a water absorbent roller, an air blow configuration in which clean air is blown onto the belt, and a combination of these. In the case of the configuration of nipping with cleaning rollers, it is desirable to make the line velocity of the cleaning rollers different from that of the belt to improve the cleaning effect.

A possible mode is one where a roller nip conveyance mechanism is used instead of the suction belt conveyance unit 22. However, if the print region is conveyed by a roller nip mechanism, then a roller comes into contact with the printed surface of the recording paper immediately after printing, and therefore a problem occurs in that the image is liable to bleeding. Therefore, a suction belt conveyance mechanism such as that of the present embodiment, in which a roller does not make contact with the printed surface, is desirable.

A treatment liquid deposition unit 38 and a heating fan 40 are disposed in this order on the upstream side of the print unit 12 in the recording paper conveyance pathway formed by the suction belt conveyance unit 22.

The treatment liquid deposition unit 38 comprises a roller for applying a treatment liquid that insolubilizes or aggregates the coloring material in the ink onto the printing surface of the recording paper 16. The roller is longer than the width of the recording paper 16, and treatment liquid is applied in a substantially uniform fashion over the printing surface of the recording paper 16 by means of the roller. Here, the treatment liquid is, for example, an ink aggregating treatment agent comprising Citric acid (made by Wako Pure Chemical Industries, Ltd): 16.7%, diethylene glycol monomethyl ether (made by Wako Junsei): 20.0%, Zonyl FSN-100 (made by Du Pont Inc.): 1.0%, and deionized water: 62.3%.

The treatment liquid may be applied using a print head similar to the print unit 12, for example.

The heating fan 40 blows heated air onto the recording paper 16 to heat the recording paper 16 immediately before printing so that the ink deposited on the recording paper 16 dries more easily. By this means, a portion of the solvent of the treatment liquid is evaporated off and the ink is prevented from moving about on the recording paper 16.

Figure 2:
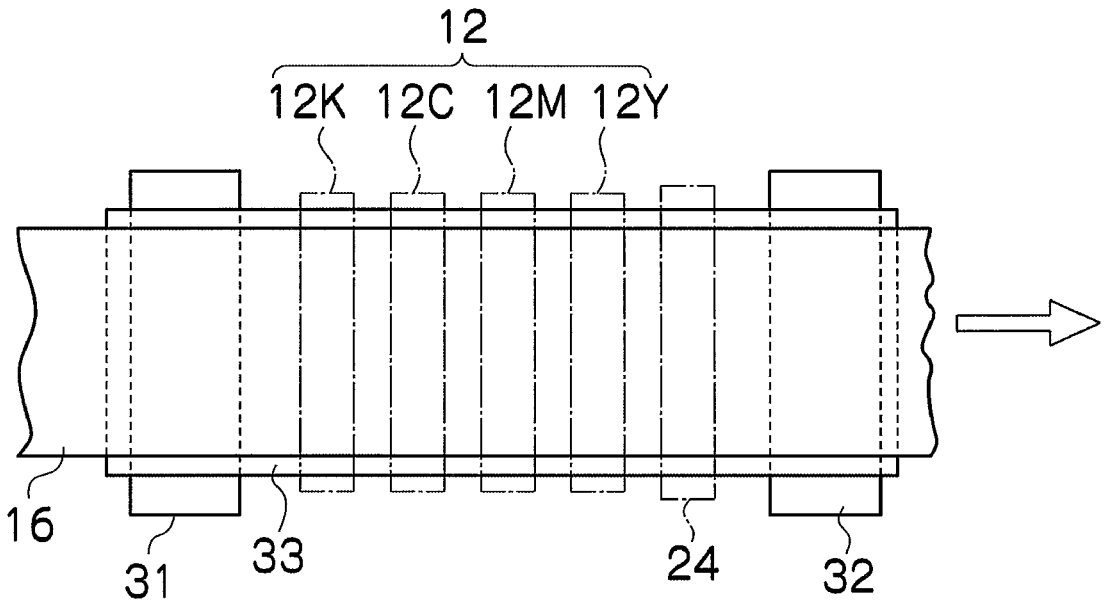
FIG. 2 is a principal plan diagram of the peripheral area of a print unit in the inkjet recording apparatus illustrated in FIG. 1.
Figure 3A:
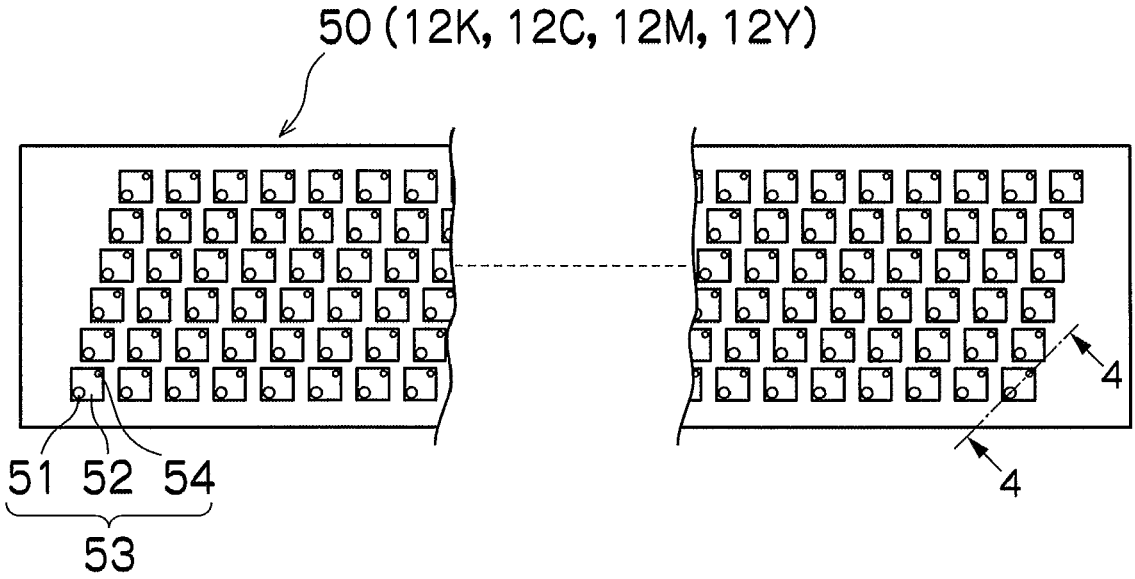
FIGS. 3A and 3B are plan view perspective diagrams illustrating an example of the composition of a print head.
Figure 3B:
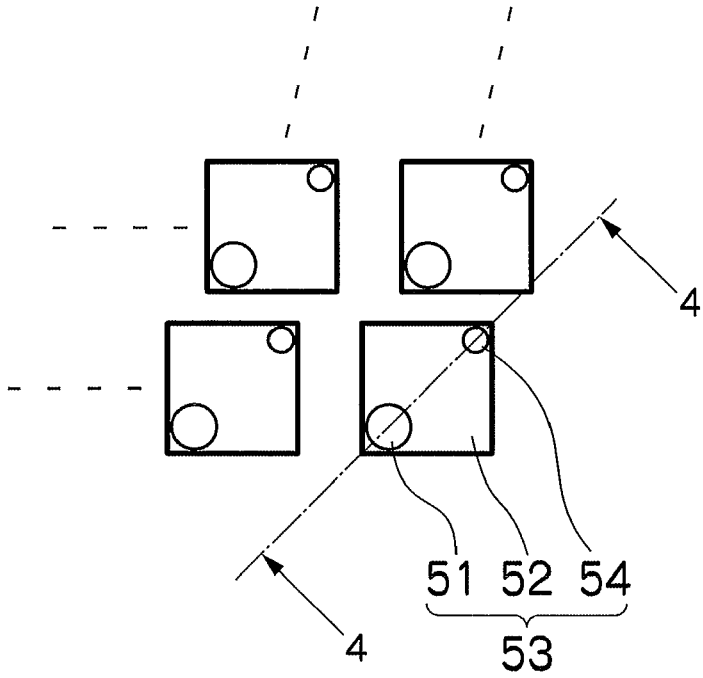
Figure 4:
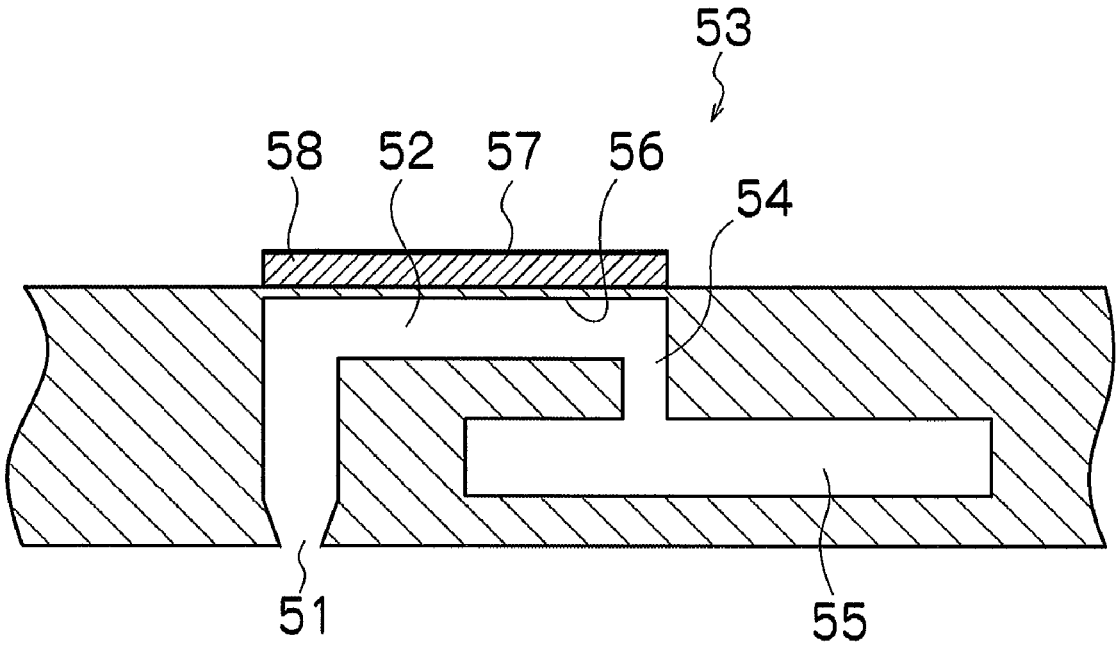
FIG. 4 is a cross-sectional diagram along line 4-4 in FIGS. 3A and 3B.

The print unit 12 is a so-called "full line head" in which a line head having a length corresponding to the maximum paper width is arranged in a direction (main scanning direction) that is perpendicular to the paper feed direction (sub-scanning direction) (see FIG. 2). Although a detailed example of the structure is described hereinafter, as illustrated in FIG. 2, the print heads 12K, 12C, 12M and 12Y are constituted by line heads in which a plurality of ink ejection ports (nozzles) are arranged in the through a length exceeding at least one side of the maximum size recording paper 16 intended for use with the inkjet recording apparatus 10 (FIGS. 3A and 3B and FIG. 4).

Heads 12K, 12C, 12M, 12Y corresponding to respective ink colors are disposed in the order, black (K), cyan (C), magenta (M) and yellow (Y), from the upstream side, following the feed direction of the recording paper 16 (called the paper feed direction below). A color print is formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scanning action). Higher-speed printing is thereby made possible and productivity can be improved in comparison with a shuttle type head in which a recording head moves reciprocally in the main scanning direction.

In the present embodiment, a composition using the four standard colors of K, C, M and Y is described, but the combination of ink colors and the number of ink colors are not limited to the present embodiment. For example, it is also possible to add light inks and dark inks to the four inks K, C, M and Y. For example, a configuration is possible in which inkjet heads for ejecting light-colored inks such as light cyan and light magenta are added.

As illustrated in FIG. 1, the ink storing and loading unit 14 has ink tanks for storing the inks of K, C, M and Y to be supplied to the print heads 12K, 12C, 12M, and 12Y, and the tanks are connected to the print heads 12K, 12C, 12M, and 12Y by means of channels (not illustrated). The ink storing and loading unit 14 has a warning device (for example, a display device or an alarm sound generator) for warning when the remaining amount of any ink is low, and has a mechanism for preventing loading errors among the colors.

The print determination unit 24 comprises an image sensor for capturing images of the droplet ejection results of the print unit 12. The print determination unit 24 functions as a device which checks for nozzle blockages and other ejection defects from the droplet ejection image read in by the image sensor.

The print determination unit 24 according to the present embodiment includes at least a line sensor having rows of photoreceptor elements (rows of photoelectric transducing elements) with a width that is greater than the ink droplet ejection width (image recording width) of the print heads 12K, 12C, 12M and 12Y. This line sensor is a color separation line CCD sensor comprising an R sensor row in which photoelectric transducing elements (pixels) provided with a red (R) color filter are arranged in a line, a G sensor row provided with a green (G) color filter and a B sensor row provided with a blue (B) color filter. It is also possible to use an area sensor in which photoreceptor elements are arranged in a two-dimensional configuration, instead of a line sensor.

The print determination unit 24 reads in the test pattern printed by the print heads 12K, 12C, 12M and 12Y of the respective colors, and determines the ejection performed by the respective heads. Here, the ejection determination means measures the presence or absence of ink ejection, the dot size and the dot depositing position, for example. A post-drying unit 42 is disposed following the print determination unit 24. The post-drying unit 42 is a device to dry the printed image surface, and includes a heating fan, for example. It is desirable to avoid contact with the printed surface until the printed ink dries, and a device that blows heated air onto the printed surface is desirable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are desirably outputted separately. In the inkjet recording apparatus 10 according to the present embodiment, a sorting device (not illustrated) is provided for switching the outputting pathways in order to sort the printed matter with the target print and the printed matter with the test print, and to send them to paper output units 26A and 26B, respectively. When the target print and the test print are simultaneously formed in parallel on the same large sheet of recording paper, the test print portion is cut and separated by a cutter (second cutter) 48. The cutter 48 is disposed directly before the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Next, the structure of a print head will be described. The heads 12K, 12C, 12M and 12Y provided for respective ink colors have the same structure, and a reference numeral 50 is hereinafter designated to any of the print heads.

FIG. 3A is a perspective plan view illustrating an example of the configuration of the print head 50, and FIG. 3B is an enlarged view of a portion thereof. FIG. 4 is a cross-sectional diagram illustrating the composition of an ink chamber unit (a cross-sectional diagram along line 4-4 in FIGS. 3A and 3B).

As illustrated in FIGS. 3A and 3B and FIG. 4, the print head 50 according to the present embodiment has a structure in which a plurality of ink chamber units 53 each comprising a nozzle 51 for ejecting an ink droplet and a pressure chamber 52 corresponding to the nozzle 51, and the like, are arranged in a staggered matrix configuration. Consequently, a high density can be achieved in the apparent nozzle pitch.

The planar shape of the pressure chamber 52 provided for each nozzle 51 is substantially a square, and the nozzle 51 and supply port 54 are disposed in both corners on a diagonal line of the square.

An actuator 58 provided with an individual electrode 57 is bonded to a pressure plate 56 which forms the upper face of the pressure chamber 52, and the actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

Figure 5:
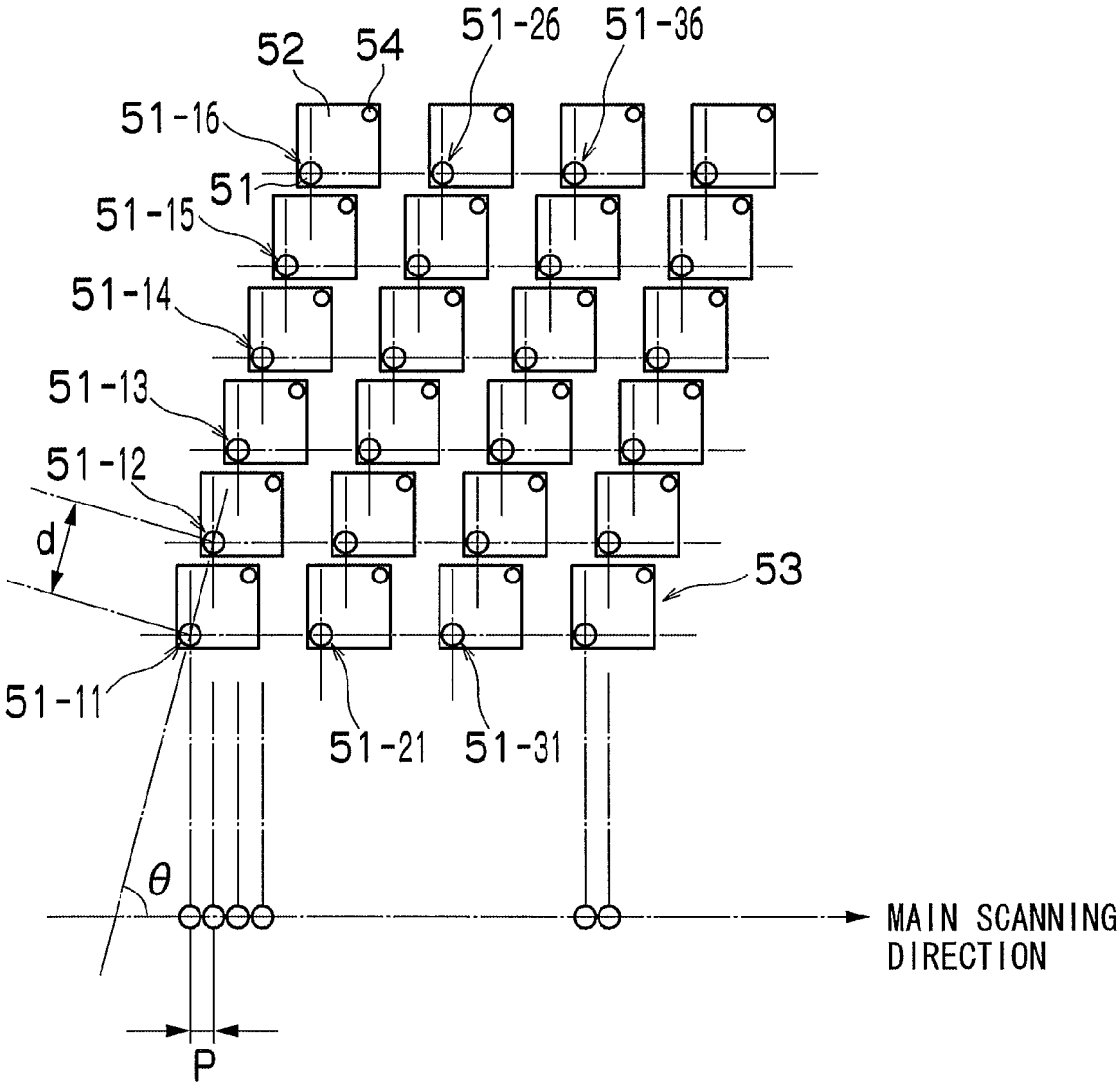
FIG. 5 is an enlarged view illustrating a nozzle arrangement in the print head illustrated in FIGS. 3A and 3B.

As illustrated in FIG. 5, a plurality of ink chamber units 53 having this structure are arranged in a lattice configuration, based on a fixed arrangement pattern having a row direction which coincides with the main scanning direction, and a column direction which is inclined at a fixed angle of $\theta$ with respect to the main scanning direction, rather than being perpendicular to the main scanning direction. By adopting a structure in which a plurality of ink chamber units 53 are arranged at a uniform pitch d in a direction at an angle of $\theta$ with respect to the main scanning direction, the pitch P of the nozzles when projected in the main scanning direction is $d \times \cos\theta$.

In other words, the nozzle arrangement can be treated as equivalent to an arrangement where the nozzles 51 are arranged linearly at a uniform pitch P in the main scanning direction. By means of this composition, it is possible to achieve a nozzle composition of high density, in which the nozzle columns projected in the main scanning direction reach a total of 2400 per inch (2400 nozzles per inch). In order to facilitate the description, in the following explanation it is supposed that the nozzles 51 are arranged linearly at a uniform pitch (P) in the lengthwise direction (main scanning direction) of the head.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that illustrated in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording medium by sequentially driving the nozzles 51-11, 51-12, . . . , 51-16 in accordance with the conveyance velocity of the recording medium (recording paper 16).

On the other hand, "sub-scanning" is defined as to repeatedly perform printing of one line (a line formed of a row of dots, or a line formed of a plurality of rows of dots) formed by the main scanning, while moving the full-line head and the recording paper 16 relatively to each other.

Figure 6:
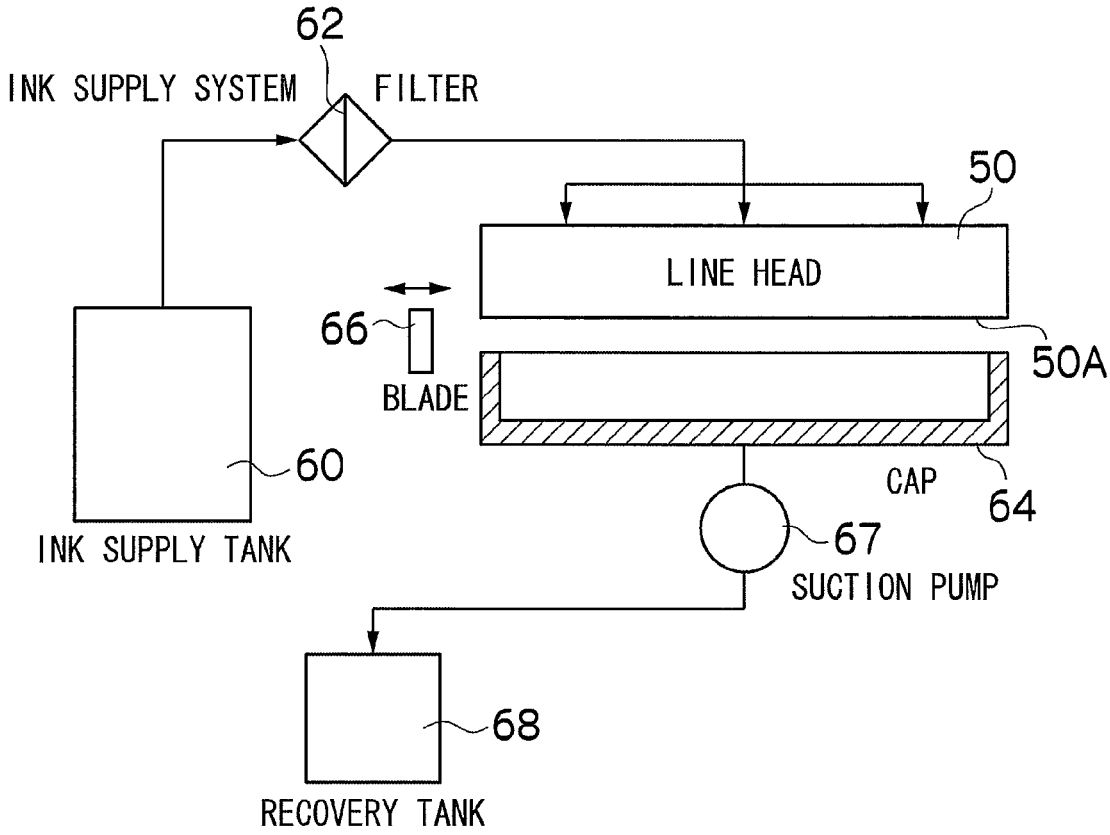
FIG. 6 is a schematic drawing illustrating the composition of an ink supply system in the inkjet recording apparatus according to an embodiment of the invention.

FIG. 6 is a schematic drawing illustrating the configuration of the ink supply system in the inkjet recording apparatus 10.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not illustrated) and the ink tank 60 of the cartridge type is replaced with a new one. In order to change the ink type in accordance with the intended application, the cartridge type is suitable, and it is desirable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as illustrated in FIG. 6. The filter mesh size in the filter 62 is desirably equivalent to or less than the diameter of the nozzle and commonly about 20 μm.

Although not illustrated in FIG. 6, it is desirable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out and to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not illustrated), and is moved from a predetermined holding position to a maintenance position below the print head 50 as required.

The cap 64 is displaced up and down relatively with respect to the print head 50 by an elevator mechanism (not illustrated). When the power of the inkjet recording apparatus 10 is turned OFF or when in a print standby state, the cap 64 is raised to a predetermined elevated position so as to come into close contact with the print head 50, and the nozzle face is thereby covered with the cap 64.

During printing or standby, when the frequency of use of specific nozzles 51 is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

The cleaning blade 66 is composed of rubber or another elastic member, and can slide on the ink ejection surface (surface of the nozzle plate) of the print head 50 by means of a blade movement mechanism (not illustrated). When ink droplets or foreign matter has adhered to the nozzle plate, the surface of the nozzle plate is wiped and cleaned by sliding the cleaning blade 66 on the nozzle plate.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Figure 7:
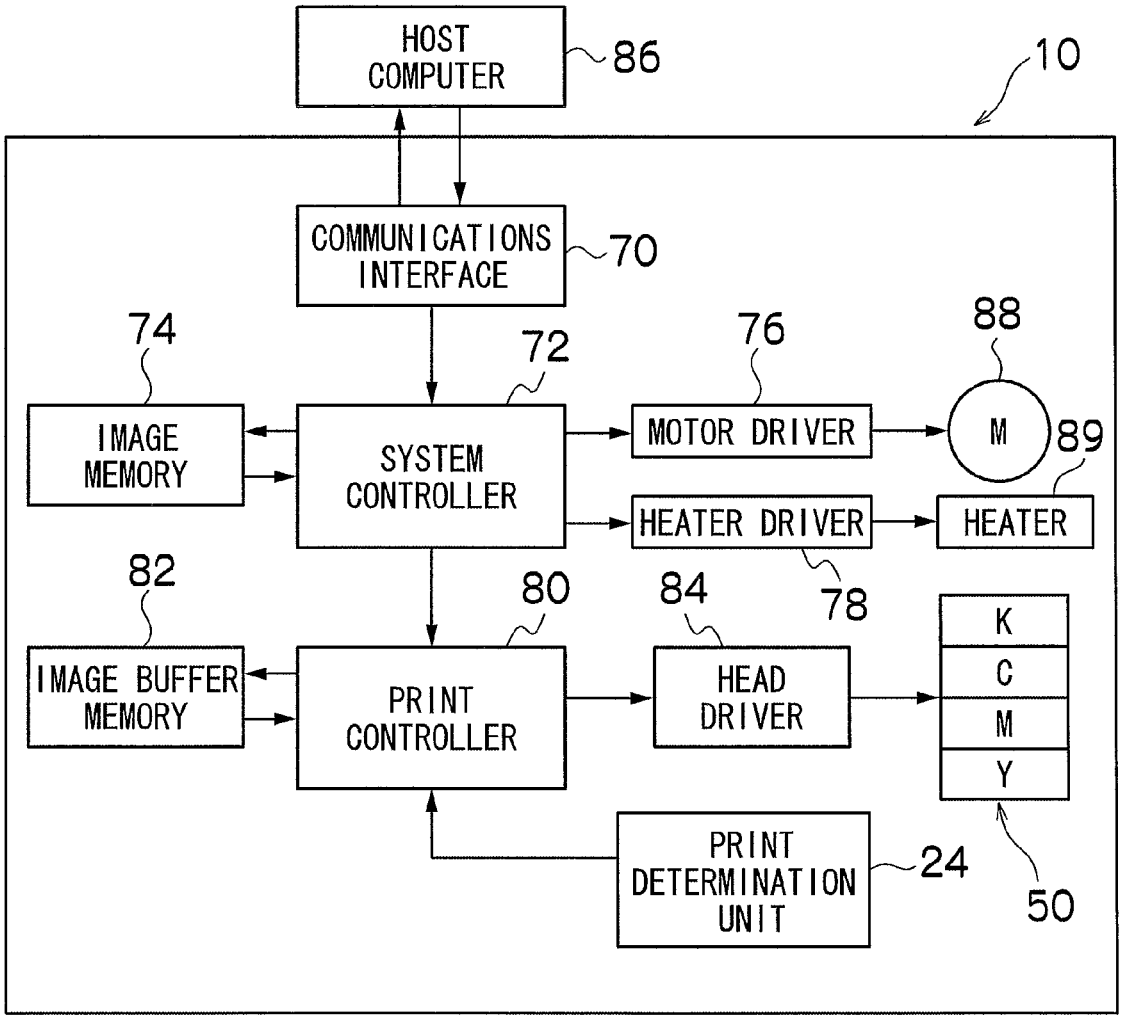
FIG. 7 is a principal block diagram illustrating a system configuration of the inkjet recording apparatus.

FIG. 7 is a block diagram illustrating the system configuration of the inkjet recording apparatus 10 of the present embodiment.

As illustrated in FIG. 7, the inkjet recording apparatus 10 comprises a communications interface 70, a system controller 72, an image memory 74, a motor driver 76, a heater driver 78, a print controller 80, an image buffer memory 82, and a head driver 84.

The communications interface 70 is an interface unit for receiving image data sent from a host computer 86. A serial interface such as USB, IEEE1394, Ethernet®, wireless network, or a parallel interface such as a Centronics interface may be used as the communications interface 70. A buffer memory (not illustrated) may be mounted in this portion in order to increase the communication speed.

The image data sent from the host computer 86 is received by the inkjet recording apparatus 10 through the communications interface 70, and is temporarily stored in the image memory 74. The image memory 74 is a storage device for temporarily storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is a control unit which controls the respective sections, such as the communications interface 70, the image memory 74, the motor driver 76, the heater driver 78, and the like. The system controller 72 is made up of a central processing unit (CPU) and peripheral circuits thereof, and as well as controlling communications with the host computer 86 and controlling reading from and writing to the image memory 74, and the like, it generates control signals for controlling the motors 88 and heaters 89 in the conveyance system.

The motor driver (drive circuit) 76 drives the motor 88 in accordance with commands from the system controller 72. The heater driver 78 drives the heater 89 of the post-drying unit 42 and the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80.

The aspect illustrated in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators of the print heads of the respective colors 12K, 12C, 12M and 12Y on the basis of print data supplied by the print controller 80. The head driver 84 can be provided with a feedback control system for maintaining constant drive conditions for the print heads.

The print determination unit 24 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print controller 80.

The print controller 80 makes various corrections and non-uniformity corrections with respect to the print head 50 on the basis of information obtained from the print determination unit 24. Details of non-uniformity correction are described later.

Figure 8:
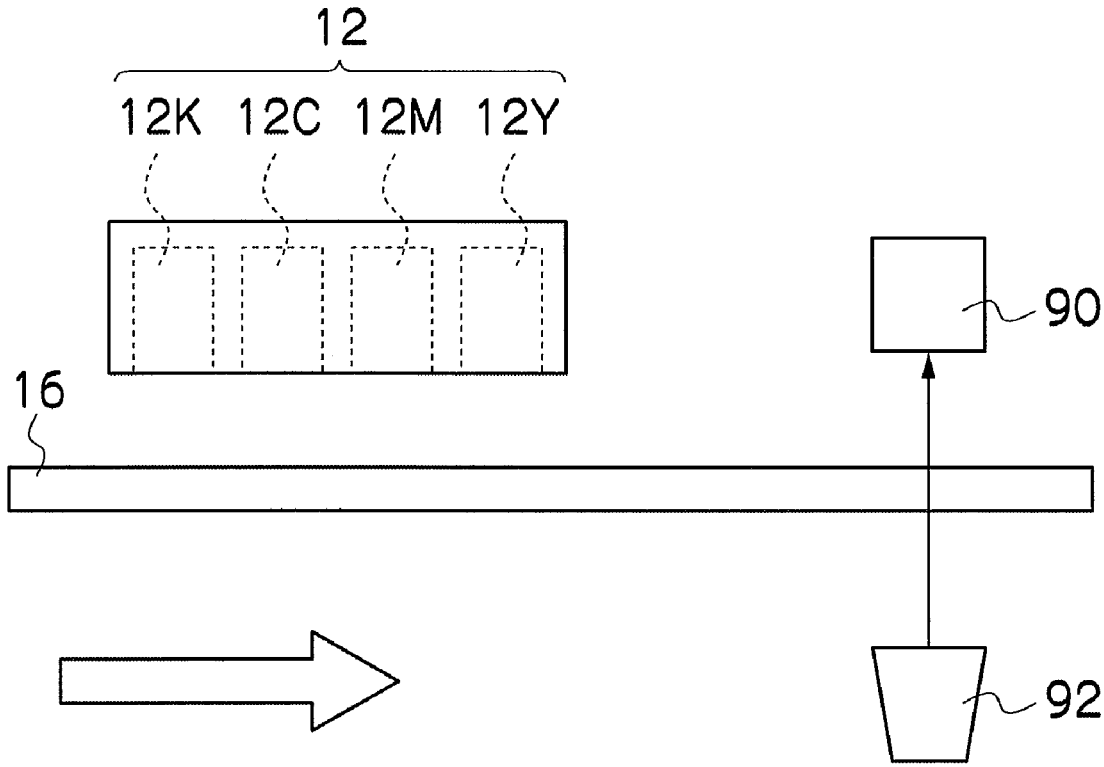
FIG. 8 is a diagram illustrating a further example of the arrangement of illumination light sources.

In the example illustrated in FIG. 1, the print determination unit 24 is provided on the print surface side of the medium, and illuminates the print surface with a light source (not illustrated) such as a cold cathode tube disposed in the vicinity of the line sensor, and reads in the reflected light with a line sensor, but in implementing the present invention, as illustrated in FIG. 8, it is also possible to dispose a line sensor 90 and a light source 92 in opposing positions on either side of the conveyance path of the recording paper 16, in such a manner that light from the light source 92 is irradiated onto the rear surface of recording paper 16 (the side opposite to the surface which receives ejected droplets), and the amount of transmitted light is read by the line sensor 90. The composition based on determination of transmitted light illustrated in FIG. 8 has a merit in that it can reduce blurring of the image read in by the line sensor, compared to a composition based on determination of reflected light.

However, in a transmission-based system, the amount of light input to the line sensor is less than in a reflection-based system. Furthermore, cases can also be envisaged where the amount of input light is also small in a reflection-based system. In either case, if the input light to the line sensor is of a low level, then a satisfactory determination signal cannot be obtained, but when reading in an image by means of a line sensor, resolution in the paper feed direction is not required and therefore this can be resolved by lengthening the charge storage time of the sensor, or integrating the read data in the paper feed direction.

Furthermore, the read start timing of the line sensor is determined from the distance between the sensor and the nozzles, and the conveyance speed of the recording paper 16.

Composition of Print Controller 80

Next, the density non-uniformity according to the present embodiment will be described.

Figure 9:
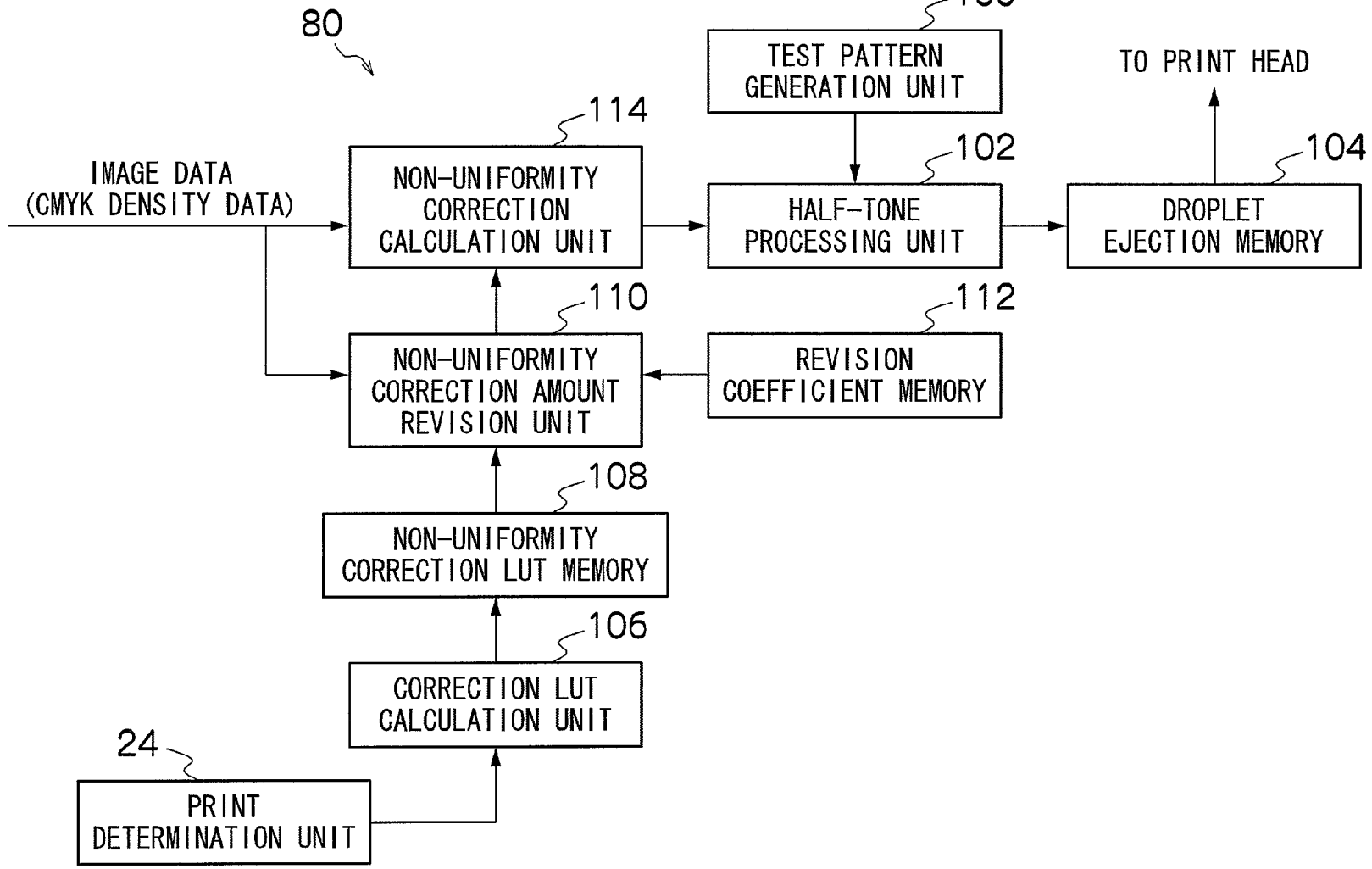
FIG. 9 is a block diagram illustrating the main composition of a print controller.

FIG. 9 is a block diagram illustrating the main composition of a print controller 80.

A test pattern generation unit 100 generates image data (CMYK density data) for a test pattern T10. The density data of the test pattern T10 is output to a half-tone processing unit 102.

The half-tone processing unit 102 converts the density data of the test pattern T10 into dot data for the respective nozzles of the print heads 12K, 12C, 12M and 12Y, in accordance with an algorithm of a commonly known error diffusion process or dithering process, for example. The dot data generated by the half-tone processing unit 102 is stored in a droplet ejection memory 104, and is then output to the print heads 12K, 12C, 12M and 12Y and printed onto the recording paper 16.

In the present embodiment, there are three sizes of the ink droplets ejected from the print heads 12K, 12C, 12M and 12Y: small droplets, medium droplets and large droplets; and the half-tone processing unit 102 carries out half-tone processing on the basis of four values: "no droplet/small droplet/medium droplet/large droplet".

Figure 10:
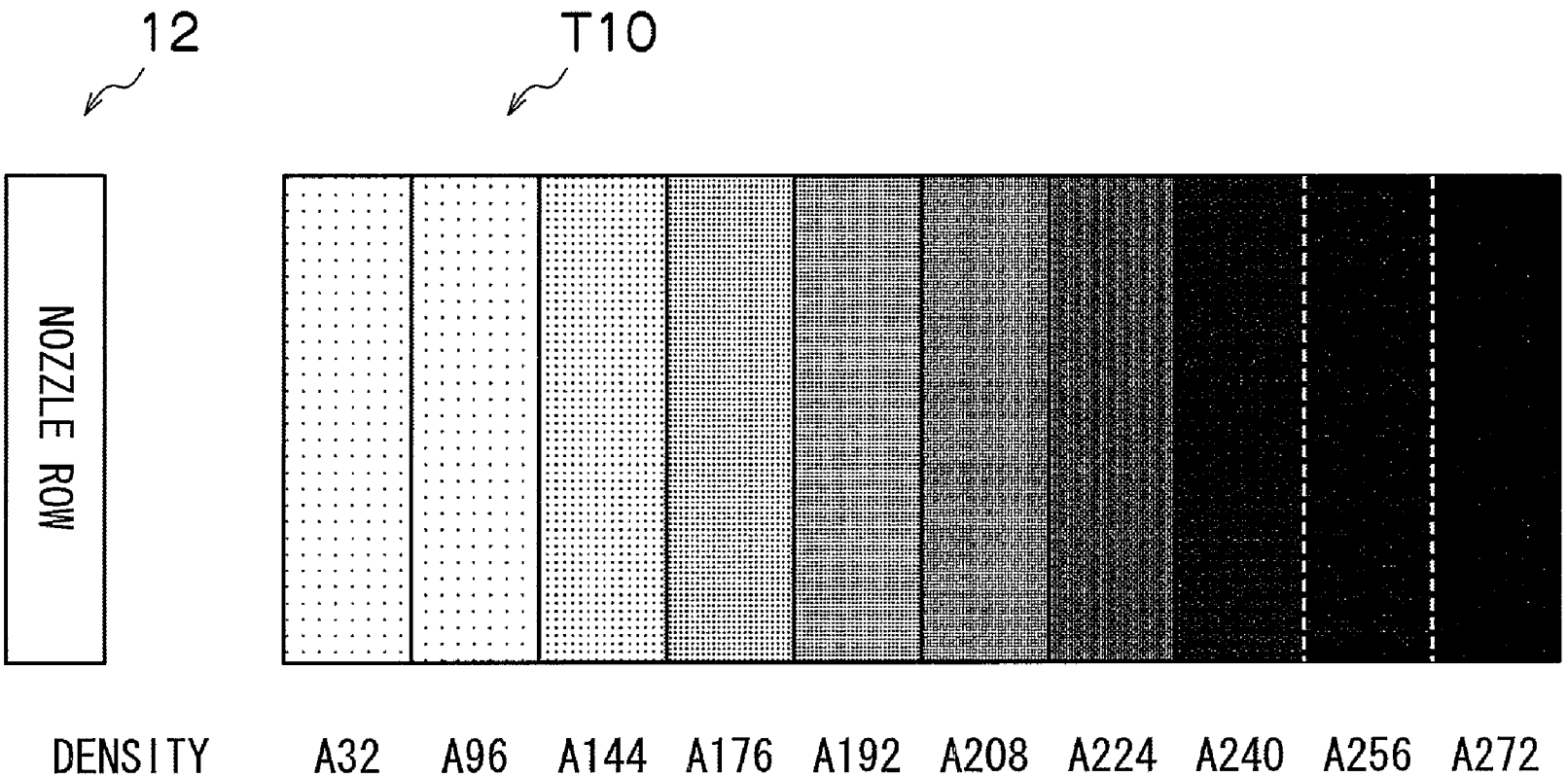
FIG. 10 is a diagram illustrating one example of a test pattern T10.

FIG. 10 is a diagram illustrating one example of a test pattern T10.

As illustrated in FIG. 10, the test pattern T10 is a pattern having a plurality of regions (hereinafter, called density regions A32, . . . , A272) in which the density changes in a stepwise fashion from 32 to 272, and is created using a single color, respectively for each of the ink colors (C, M, Y, K). When printing the test pattern T10, since half-tone processing based on four values is carried out in a similar fashion to actual printing, then the test pattern T10 is an image which contains a mixture of large, medium and small dots.

The image data input during actual printing has up to 255 values (8 bit), but as illustrated in FIG. 10, the test pattern T10 is printed up to a greater number of droplet ejection volume regions (272). This is because it may be necessary to increase the ink droplet ejection volume in order to eliminate non-uniformities in the highlight areas where the density is low, and therefore it is necessary to obtain data indicating the extent to which the droplet ejection volume should be increased. On the other hand, in actual printing which is free of non-uniformities, sufficient density is achieved even if large dots are not assigned at a rate of 100%.

The test pattern T10 for each of the colors which has been printed as described above is read in by the print determination unit 24.

A correction LUT calculation unit 106 calculates a non-uniformity look-up table (non-uniformity correction LUT) from an image of the test pattern read in by the print determination unit 24. The non-uniformity correction LUT is stored in a non-uniformity correction LUT memory 108.

Figure 11:
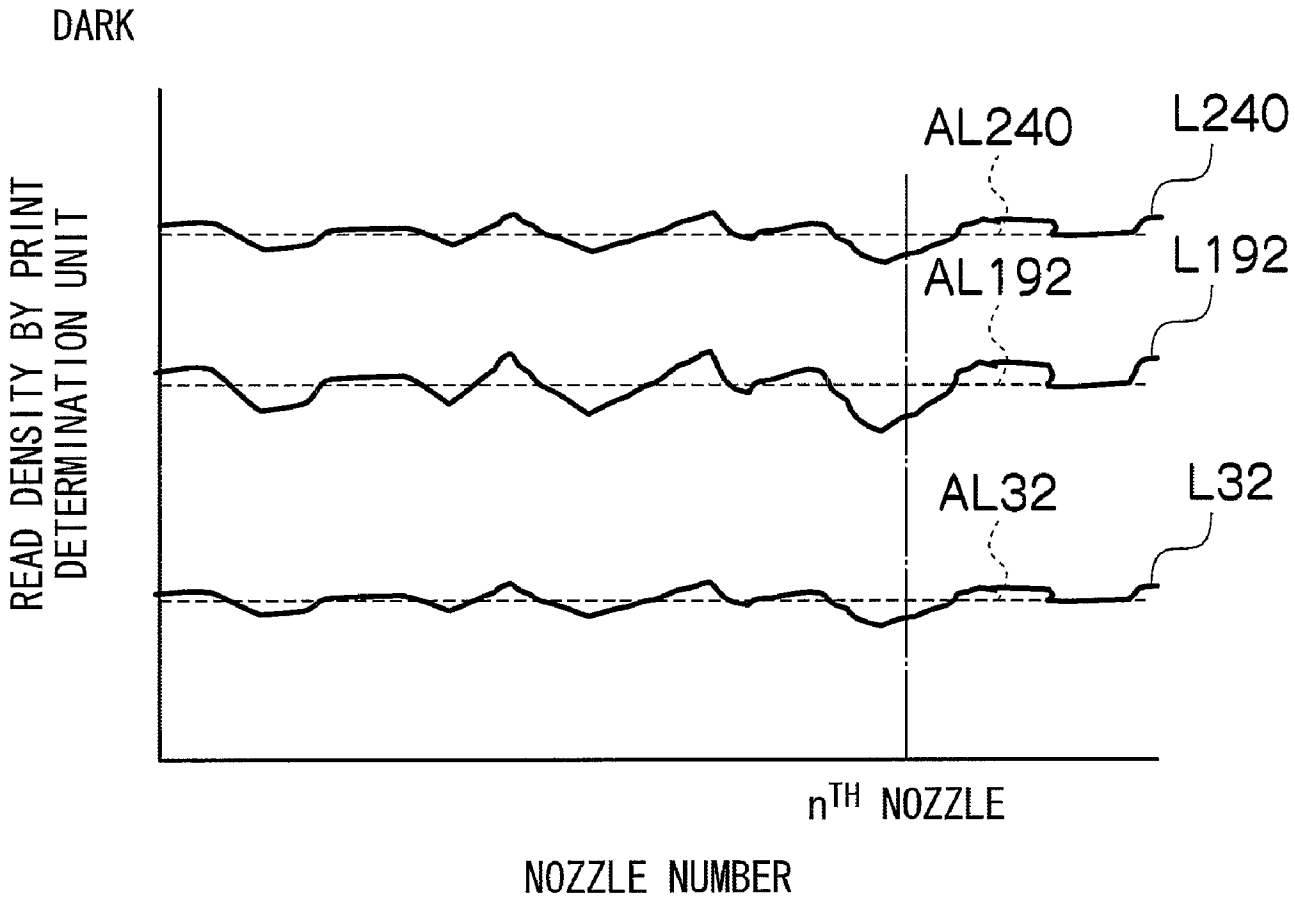
FIG. 11 is a graph illustrating density data for a test pattern T10 which is read in by the print determination unit 24.

FIG. 11 is a graph indicating density data for a test pattern T10 which is read in by the print determination unit 24.

The horizontal axis in FIG. 11 shows a number indicating the position of the nozzle (nozzle number), and the vertical axis shows density value read in (read density). FIG. 11 illustrates only the read densities for the three density regions A240, A192 and A32 of the test pattern T10 (the respective densities L240, L192 and L32), and does not illustrate the read densities of the other density regions, but the densities which are actually read in are equal in number to the number of density regions on the test pattern T10.

As illustrated in FIG. 11, the degree of non-uniformity varies according to the density region, being low in the highlight region, becoming larger in the medium to shadow regions, and then becoming small again in the vicinity of the maximum density.

The broken lines AL240, AL192 and AL32 in FIG. 11 respectively indicate the ideal values of the read densities of the density regions A240, A192 and A32 (for example, the average value of the read densities of the dots ejected from the respective nozzles in each of the density regions).

Figure 12:
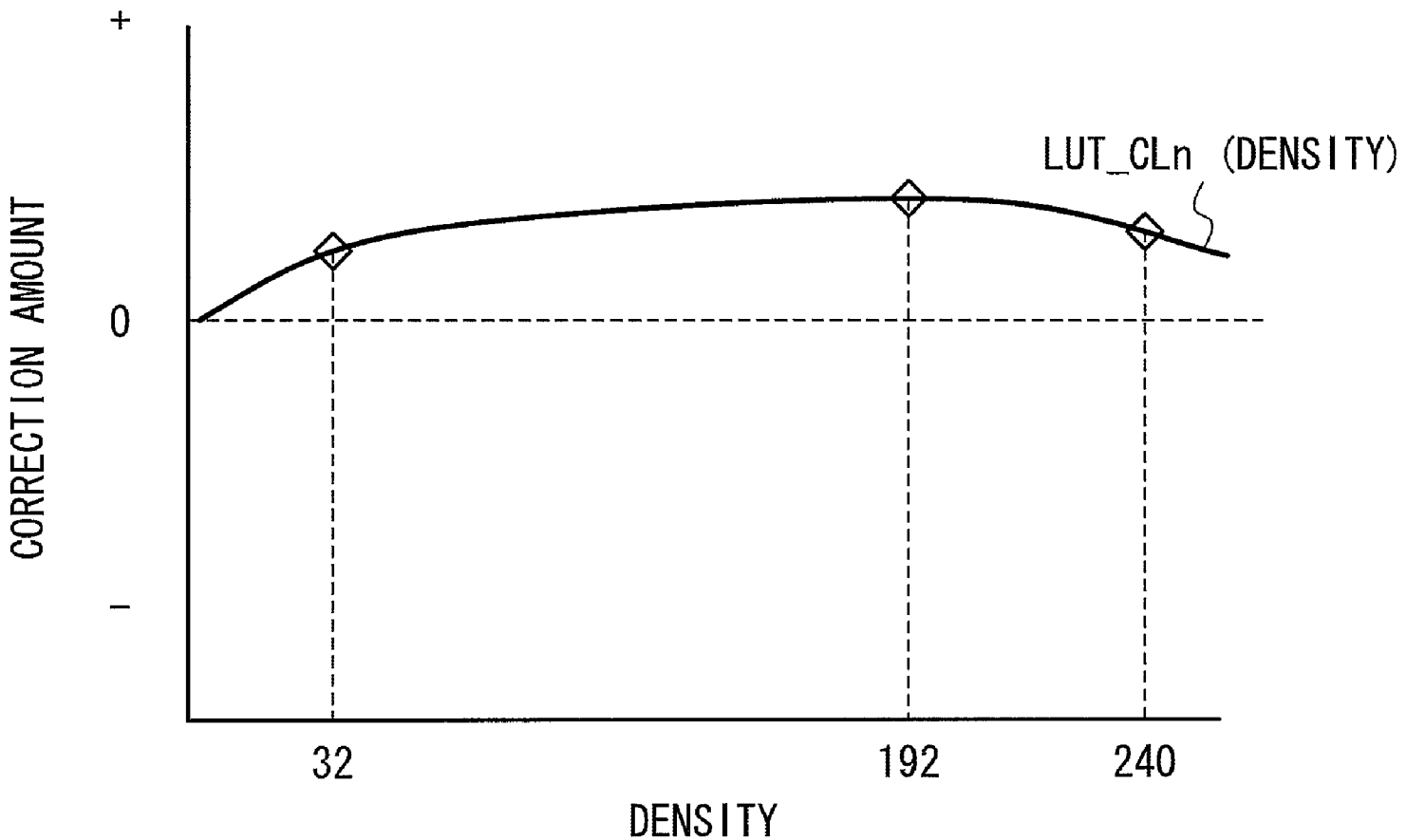
FIG. 12 is a graph illustrating differential values between the read density and the ideal value in respective density regions for a nozzle n.

FIG. 12 is a graph illustrating the differential value between the read density and the ideal value in each density region for a nozzle n.

The horizontal axis in FIG. 12 indicates the density region and the vertical axis indicates the differential between the read density and the ideal value in each respective density region. FIG. 12 illustrates only the values in the three density regions A240, A192 and A32, and does not illustrate the values for the other density regions.

The correction LUT calculation unit 106 calculates the differential between the read density and the ideal value for each density region of the test pattern T10 read in by the print determination unit 24. The correction LUT calculation unit 106 uses a least square approximation, for instance, to derive an approximation curve LUT_CLn (density) for the differential values determined for each density region, and calculates this approximation curve LUT_CLn (density) as a non-uniformity correction value for each density region. CL is any one of K, C, M and Y. The correction LUT calculation unit 106 calculates a non-uniformity correction amount for each nozzle number, and stores same in the non-uniformity correction LUT.

Next, the process of printing image data for an actual print which has been input from the host computer 86 will be described.

The non-uniformity correction amount revision unit 110 acquires the density data for each position of the image from the image data for the actual print and revises the non-uniformity correction amounts stored in the non-uniformity correction LUT on the basis of this density data.

Process of Revising Non-Uniformity Correction Amounts

A concrete description of the process of revising the non-uniformity correction amounts is given below.

Figure 13:
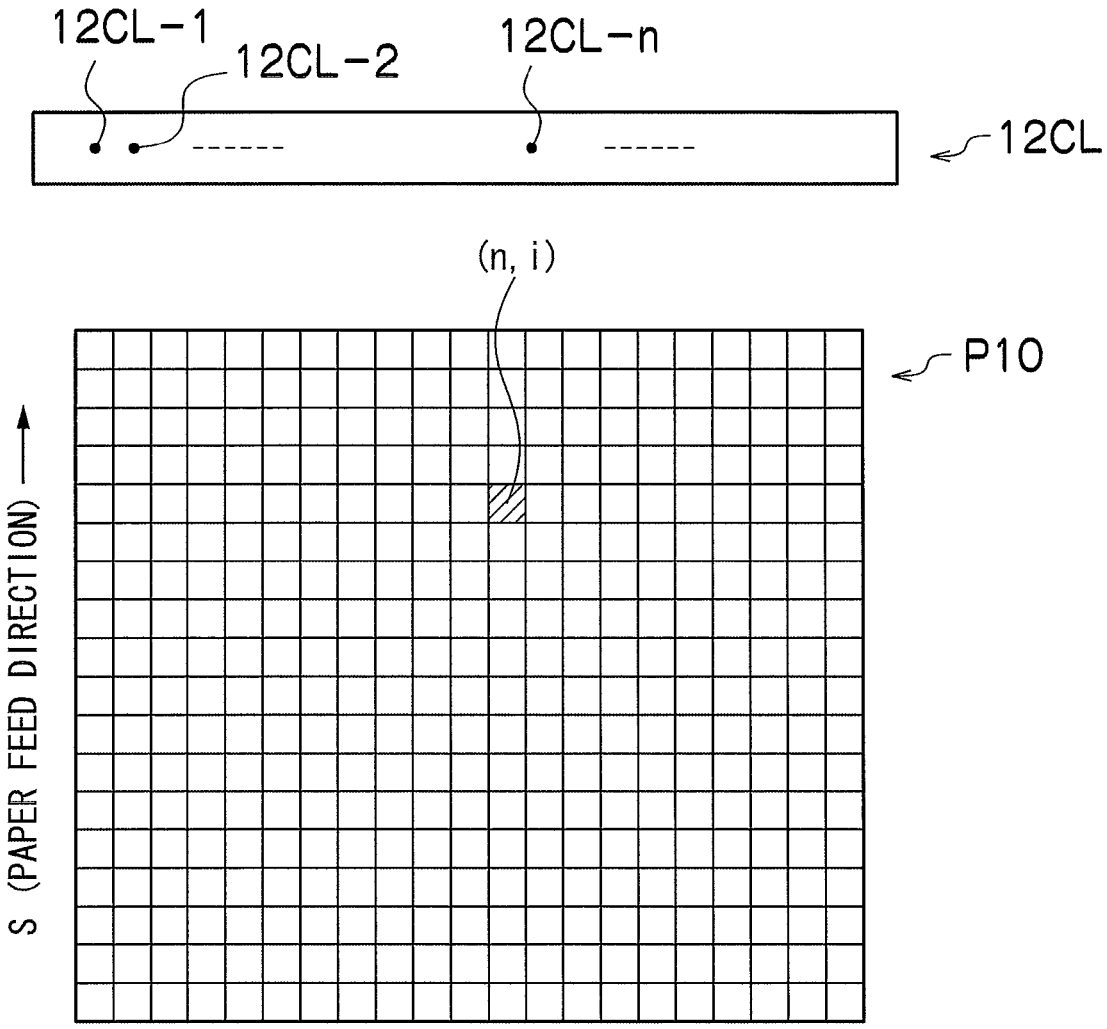
FIG. 13 is a plan diagram illustrating a schematic view of density data.

FIG. 13 is a plan diagram illustrating a schematic view of density data.

The coordinate position (n, i) in FIG. 13 corresponds to a dot formed by a droplet ejected by the $n^{th}$ nozzle 12-*n* during the $i^{th}$ sub-scanning action. In FIG. 13, the arrangement of the nozzles 12CL-1, . . . of the print head 12CL is illustrated in simplified form.

The non-uniformity correction amount revision unit 110 acquires density data corresponding to the nozzles 12CL-1, 12CL-2, . . . provided in the print head 12CL from the density data described above, and revises the non-uniformity correction amounts of the respective nozzles stored in the non-uniformity correction LUT in accordance with equations (1-1) to (1-4) below.

$$dKni=\{1-(\text{revision coefficient } C(K)\times Cni+\text{revision coefficient } M(K)\times Mni+\text{revision coefficient } Y(K)\times Yni)/(Km+Cm+Mm+Ym)\}\times LUT_Kn(Kni) \quad \text{Equation (1-1)}$$

$$dCni=\{1-(\text{revision coefficient } K(C)\times Kni+\text{revision coefficient } M(C)\times Mni+\text{revision coefficient } Y(C)\times Yni)/(Km+Cm+Mm+Ym)\}\times LUT_Cn(Cni) \quad \text{Equation (1-2)}$$

$$dMni=\{1-(\text{revision coefficient } K(M)\times Kni+\text{revision coefficient } C(M)\times Cni+\text{revision coefficient } Y(M)\times Yni)/(Km+Cm+Mm+Ym)\}\times LUT_Mn(Mni) \quad \text{Equation (1-3)}$$

$$dYni=\{1-(\text{revision coefficient } K(Y)\times Kni+\text{revision coefficient } C(Y)\times Cni+\text{revision coefficient } M(Y)\times Mni)/(Km+Cm+Mm+Ym)\}\times LUT_Yn(Yni) \quad \text{Equation (1-4)}$$

Kni, Cni, Mni and Yni are the respective density data for the colors KCMY at the positions where droplets are ejected by the $n^{th}$ nozzle 12CL-n in the $i^{th}$ ejection action in the paper feed direction S. LUT_Kn (density), LUT_Cn (density), LUT_Mn (density) and LUT_Yn (density) are the non-uniformity correction amounts for the $n^{th}$ nozzle in the non-uniform correction LUT, and they represent functions of the density data. dKni, dCni, dMni and dYni are revised non-uniformity correction amount values for the coordinate position (n, i). Km, Cm, Mm and Ym are the maximum scale values=255 (constant) of the density data of the respective colors of K, C, M and Y, after revision.

TABLE 1

| | Revision coefficient K | Revision coefficient C | Revision coefficient M | Revision coefficient Y |
|---|---|---|---|---|
| K | 0 | 0 | 0 | 0 |
| C | 0.2 | 0 | 0 | 0 |
| M | 0.2 | 0.2 | 0 | 0 |
| Y | 0.2 | 0.2 | 0.2 | 0 |

Table 1 illustrates a revision coefficient table which stores a revision coefficient K(CL), revision coefficient C(CL), revision coefficient M(CL) and revision coefficient Y(CL). CL is any one of K, C, M and Y. The revision coefficient table is stored in the revision coefficient memory 112, and the non-uniform correction amount revision unit 110 revises the non-uniformity correction amounts by referring to this revision coefficient memory 112.

The revision coefficients in Table 1 are determined assuming that the print heads are disposed in the order 12K, 12C, 12M and 12Y, from the upstream side.

By using the equations (1-1) to (1-4) described above and the revision coefficients in Table 1, the non-uniformity correction amount for the first print head 12K is not revised, but the non-uniformity correction amounts for the succeeding print heads 12C, 12M and 12Y are revised in accordance with the ink ejection volumes (densities) from the respectively preceding print heads. The non-uniformity correction amount for each ink color is revised in such a manner that the greater the total volume of ink ejected from the print heads which perform ejection of ink droplets previously, the smaller the extent of non-uniform correction (the greater the total volume of ink ejected from the print heads which perform ejection of ink droplets previously, the smaller the absolute value of the non-uniformity correction amount).

The revision coefficient K(CL), the revision coefficient C(CL), the revision coefficient M(CL) and the revision coefficient Y(CL) are values determined experimentally by taking account of the arrangement of the print heads 12CL, and they are not limited to the values illustrated in Table 1. The values of the revision coefficient K(CL), the revision coefficient C(CL), the revision coefficient M(CL) and the revision coefficient Y(CL) may be changed in accordance with the total of the ink ejection volume from the preceding print heads, as in [1] to [3] below, for example.

[1] If there are a plurality of print heads which perform ink droplet ejection previously, then a revision coefficient relating to an ink color of the print head which perform droplet ejection previously (i.e. earlier droplet ejection) is made greater than a revision coefficient relating to an ink color of the print head which perform droplet ejection subsequently (i.e. later droplet ejection).

[2] If the ink aggregation rate of a print head which performs ink droplet ejection previously is fast, then a revision coefficient relating to the ink color of that print head is made large. If the aggregation rate is slow, then a revision coefficient relating to the ink color of that print head is made small, and if there are a plurality of print heads which perform ink droplet ejection previously, then of these heads, the revision coefficient relating to an ink of a print head which performs droplet ejection later is made larger.

[3] If the extent of aggregation of the ink of a print head which performs ink droplet ejection previously is small (e.g., if the amount of treatment liquid used by the ink from a print head which performs ink droplet ejection previously is small, and if the material in the treatment liquid that is required to aggregate the ink of succeeding print heads is still remaining), then the revision coefficient relating to the ink of the print head which performs ink droplet ejection previously is made small.

The non-uniformity correction calculation unit 114 corrects the density data in accordance with equations (2-1) to (2-4) below, using the non-uniformity correction amounts dKni, dCni, dMni, dYni which have been revised on the basis of equations (1-1) to (1-4) above.

$$K'ni=Kni+dKni \quad \text{Equation (2-1)}$$

$$C'ni=Cni+dCni \quad \text{Equation (2-2)}$$

$$M'ni=Mni+dMni \quad \text{Equation (2-3)}$$

$$Y'ni=Yni+dYni \quad \text{Equation (2-4)}$$

The half-tone processing unit 102 converts the density data K'ni, C'ni, M'ni, Y'ni corrected by the non-uniformity correction calculation unit 114 on the basis of a commonly known error diffusion processing algorithm or dithering algorithm into dot data with respect to each nozzle of the print heads 12K, 12C, 12M and 12Y. The dot data created as described above is output to the print heads 12K, 12C, 12M and 12Y via the droplet ejection memory 104, and an actual print of the image is created.

Further Embodiments of the Process of Revising the Non-Uniformity Correction Amounts Next, further embodiments of the process of revising the non-uniformity correction amounts will be described.

In the present embodiment, the non-uniformity correction amount revision unit 110 revises the non-uniformity correction amounts LUT_CLn(CLni) in the non-uniformity correction LUT, by using equation (3) below and the revision coefficients CL(K,C,M,Y) ((K(K,C,M,Y), C(K,C,M,Y), M(K,C,M,Y), Y(K,C,M,Y)) in Table 2. The non-uniformity correction calculation unit 114 corrects the density data in accordance with equations (2-1) to (2-4) above, using the non-uniformity correction amounts dCLni (dKni, dCni, dMni, dYni) that have been revised on the basis of equation (3) below. CL may be any one of K, C, M and Y $$\begin{aligned} dCLni = \{&(255-Kni)\times(255-Cni)\times(255-Mni)\times(255-Yni)\times \\ &\text{revision coefficient } CL(0,0,0,0)+ \\ &(255-Kni)\times(255-Cni)\times(255-Mni)\times \\ &(Yni)\times\text{revision coefficient } CL(0,0,0,255) \end{aligned} \quad \text{Equation (3)}$$

-continued $$\begin{aligned} &(255-Kni)\times(255-Cni)\times(Mni)\times(255-Yni)\times \\ &\text{revision coefficient } CL(0,0,255,0)+ \\ &(255-Kni)\times(255-Cni)\times(Mni)\times(Yni)\times \\ &\text{revision coefficient } CL(0,0,255,255)+ \\ &(255-Kni)\times(Cni)\times(255-Mni)\times \\ &(255-Yni)\times\text{revision coefficient } CL(0,255,0,0)+ \\ &(255-Kni)\times(Cni)\times(255-Mni)\times(Yni)\times \\ &\text{revision coefficient } CL(0,255,0,255)+ \\ &(255-Kni)\times(Cni)\times(Mni)\times(255-Yni)\times \\ &\text{revision coefficient } CL(0,255,255,0)+ \\ &255-Kni)\times(Cni)\times(Mni)\times(Yni)\times \\ &\text{revision coefficient } CL(0,255,255,255)+ \\ &(Kni)\times(255-Cni)\times(255-Mni)\times \\ &(255-Yni)\times\text{revision coefficient } CL(255,0,0,0)+ \\ &(Kni)\times(255-Cni)\times(255-Mni)\times(Yni)\times \\ &\text{revision coefficient } CL(255,0,0,255)+ \\ &(Kni)\times(255-Cni)\times(Mni)\times(255-Yni)\times \\ &\text{revision coefficient } CL(255,0,255,0)+ \\ &(Kni)\times(255-Cni)\times(Mni)\times(Yni)\times \\ &\text{revision coefficient } CL(255,0,255,255)+ \\ &(Kni)\times(Cni)\times(255-Mni)\times(255-Yni)\times \\ &\text{revision coefficient } CL(255,255,0,0)+ \\ &(Kni)\times(Cni)\times(255-Mni)\times(Yni)\times \\ &\text{revision coefficient } CL(255,255,0,255)+ \\ &(Kni)\times(Cni)\times(Mni)\times(255-Yni)\times \\ &\text{revision coefficient } CL(255,255,255,0)+ \\ &(Kni)\times(Cni)\times(Mni)\times(Yni)\times \\ &\text{revision coefficient } CL(255,255,255,255)\}/ \\ &(255\times255\times255\times255)\times\text{LUT_CLn}(CLni) \end{aligned}$$

TABLE 2

| K | C | M | Y | Revision coefficient K | Revision coefficient C | Revision coefficient M | Revision coefficient Y |
|---|---|---|---|---|---|---|---|
| 0 | 0 | 0 | 0 | 0 | 0 | 0 | 0 |
| 0 | 0 | 0 | 255 | 0 | 0 | 0 | 0 |
| 0 | 0 | 255 | 0 | 0 | 0 | 0 | 0.1 |
| 0 | 0 | 255 | 255 | 0 | 0 | 0 | 0.1 |
| 0 | 255 | 0 | 0 | 0 | 0 | 0.1 | 0.15 |

TABLE 2-continued

| K | C | M | Y | Revision coefficient K | Revision coefficient C | Revision coefficient M | Revision coefficient Y |
|---|---|---|---|---|---|---|---|
| 0 | 255 | 0 | 255 | 0 | 0 | 0.1 | 0.15 |
| 0 | 255 | 255 | 0 | 0 | 0 | 0.1 | 0.25 |
| 0 | 255 | 255 | 255 | 0 | 0 | 0.1 | 0.25 |
| 255 | 0 | 0 | 0 | 0 | 0.1 | 0.15 | 0.15 |
| 255 | 0 | 0 | 255 | 0 | 0.1 | 0.15 | 0.15 |
| 255 | 0 | 255 | 0 | 0 | 0.1 | 0.15 | 0.3 |
| 255 | 0 | 255 | 255 | 0 | 0.1 | 0.15 | 0.3 |
| 255 | 255 | 0 | 0 | 0 | 0.1 | 0.25 | 0.35 |
| 255 | 255 | 0 | 255 | 0 | 0.1 | 0.25 | 0.35 |
| 255 | 255 | 255 | 0 | 0 | 0.1 | 0.25 | 0.35 |
| 255 | 255 | 255 | 255 | 0 | 0.1 | 0.25 | 0.35 |

Figure 14B:
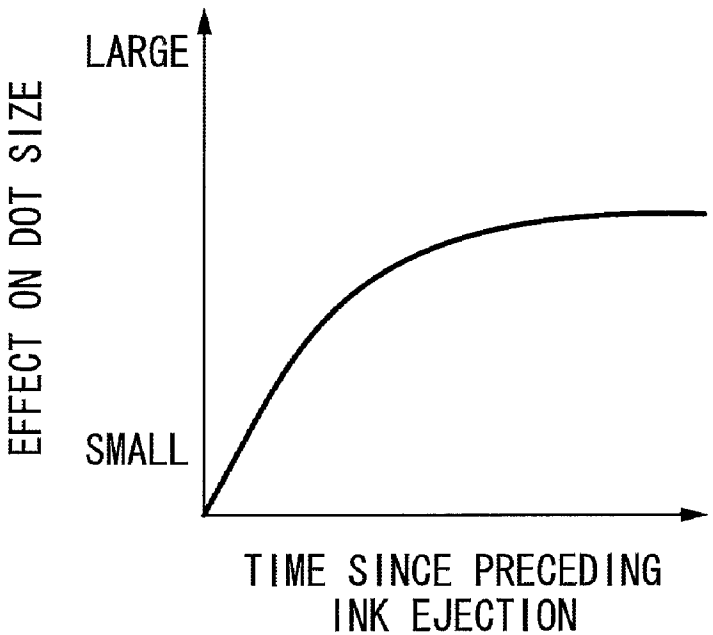
FIG. 14B is a graph illustrating the effect on dot size by the elapsed time from the ejection of droplets by a preceding print head.
Figure 14A:
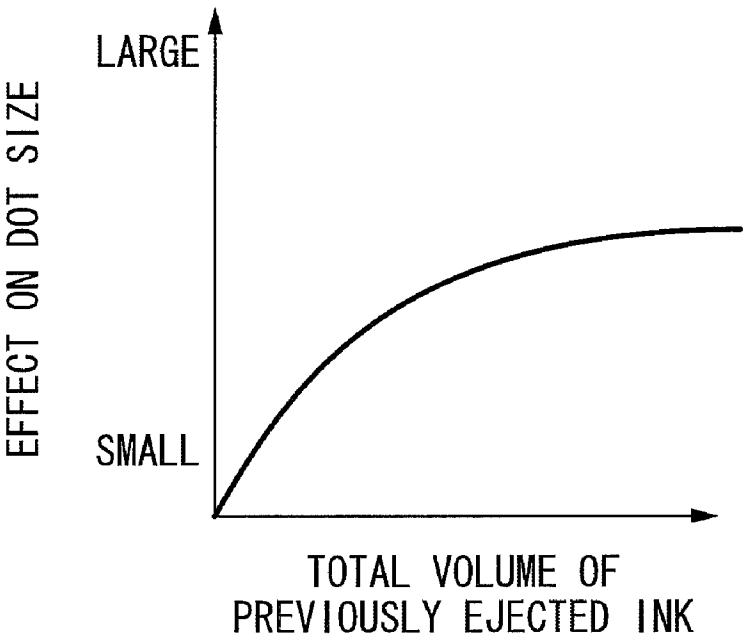
FIG. 14A is a graph illustrating the effect on dot size by the total volume of droplets ejected from a preceding print head.

According to equation (3) above, revision coefficients CL(Kni, Cni, Mni, Yni) for the densities (Kni, Cni, Mni, Yni) are determined from the revision coefficients at the following 16 grid points in the four-dimensional space (K,C,M,Y), (0,0,0,0), (0,0,0,255), (0,0,255,0), (0,0,255,255), (0,255,0,0), (0,255,0,255), (0,255,255,0), (0,255,255,255), (255,0,0,0), (255,0,0,255), (255,0,255,0), (255,0,255,255), (255,255,0,0), (255,255,0,255), (255,255,255,0), (255,255,255,255), (the respective revision coefficients from CL (0,0,0,0), to CL (0,0,0,255), . . . , CL (255,255,255,255)), by means of an interpolation operation using the volume ratio of three-dimensional shapes (multi-vesicular bodies) in the four-dimensional space (K,C,M,Y), and these revision coefficients CL(Kni, Cni, Mni, Yni) is multiplied by the non-uniformity correction amount values LUT_CLn(CLni) acquired from the non-uniformity correction LUT described above for revision. By performing non-uniformity correction using the non-uniformity correction amounts dCLni (dKni, dCni, dMni, dYni) which have been revised by means of equation (3) above, it is possible to revise the non-uniformity correction values so as to account for the non-linearity of the effects on the dot size of the total volume of the droplets ejected from the preceding print heads and the elapsed time from the droplet ejection by the preceding print heads, as indicated by the graphs in FIGS. 14A and 14B. Therefore, it is possible to revise the non-uniformity correction amounts with a high degree of accuracy, compared to the case where the above equations (1-1) to (1-4) are used.

The revision coefficients CL(K,C,M,Y) (K(K,C,M,Y), C(K,C,M,Y), M(K,C,M,Y), Y(K,C,M,Y)) are determined in the following manner, for example.

[1] A test pattern T10 of a single color is printed onto recording paper 16 on which a standard deposition volume of treatment liquid has been deposited, and a non-uniformity correction LUT is determined on the basis of the read densities read out from this test pattern T10.

[2] A test pattern T10 is printed onto recording paper 16 on which treatment liquid of a standard volume minus the amount consumed by preceding droplet ejection has been deposited, and a non-uniformity correction LUT is determined on the basis of the read densities read out from this test pattern T10. This is carried out for each of the possible combinations of preceding inks.

[3] The revision coefficients are determined by comparing the non-uniformity correction amounts in [1] and [2]. In the present embodiment, for each of the density data values corresponding to the grid points in a four-dimensional space (K, C, M, Y) (namely, the density data values ((0,0,0,255), . . . (255,255,255,255)), the ratio between the non-uniformity correction LUT value in [1] above and the non-uniformity correction LUT value in [2] above is determined as the revision coefficient. However, since the non-uniformity correction amount for density data values in the vicinity of zero is extremely small, then there is a large variation in the ratio of these non-uniformity correction amounts. Therefore, in the present embodiment, since the number of grid points is small, then as the revision coefficients relating to a grid point which correspond to a density data value of 0 (for example, (0,0,0,0)), the revision coefficients for an adjacent grid point (a density data value 255, for example, (0,0,0,255)) are employed, as illustrated in Table 2.

The revision coefficient table in Table 2 is a four-dimensional look-up table for one grid, but if the number of grids is increased, then the accuracy can be raised.

Figure 15:
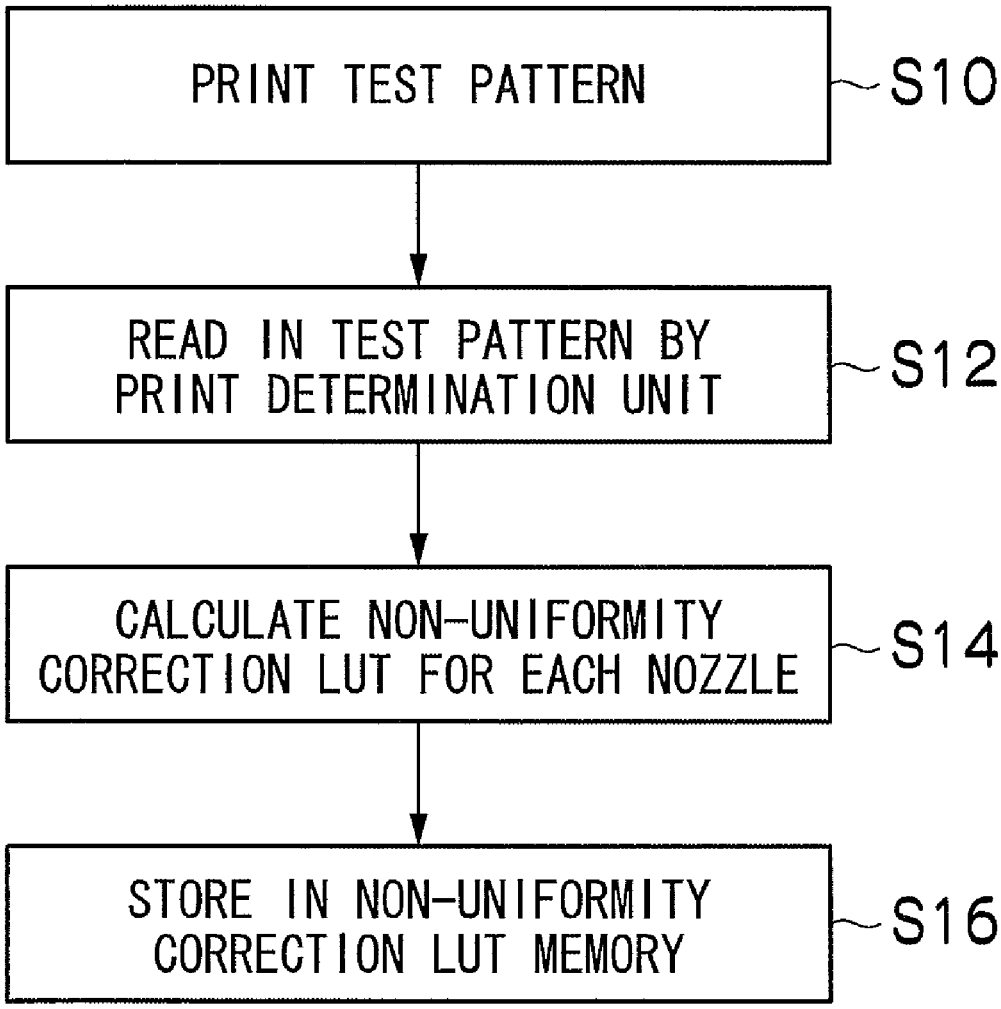
FIG. 15 is a flowchart illustrating the sequence of processing for creating a non-uniformity correction LUT.

FIG. 15 is a flowchart illustrating the sequence of processing for creating a non-uniformity correction LUT.

Firstly, image data for a test pattern T10 (CMYK density data) is generated by the test pattern generation unit 100, and this image data is printed onto recording paper 16 (step S10).

Thereupon, the image of the test pattern T10 is read in by the print determination unit 24 (step S12), and density data for each nozzle is acquired from the image of the test pattern T10. The correction LUT calculation unit 106 then calculates non-uniformity correction amounts by subtracting the read density corresponding to each nozzle from the ideal value (for example, the average value of the read densities of the dots ejected from the respective nozzles in respective density regions), and stores these non-uniformity correction amounts in the non-uniformity correction LUT (step S14). The non-uniformity correction LUT calculated at step S14 is stored in the non-uniformity correction LUT memory 108 (step S16).

Figure 16:
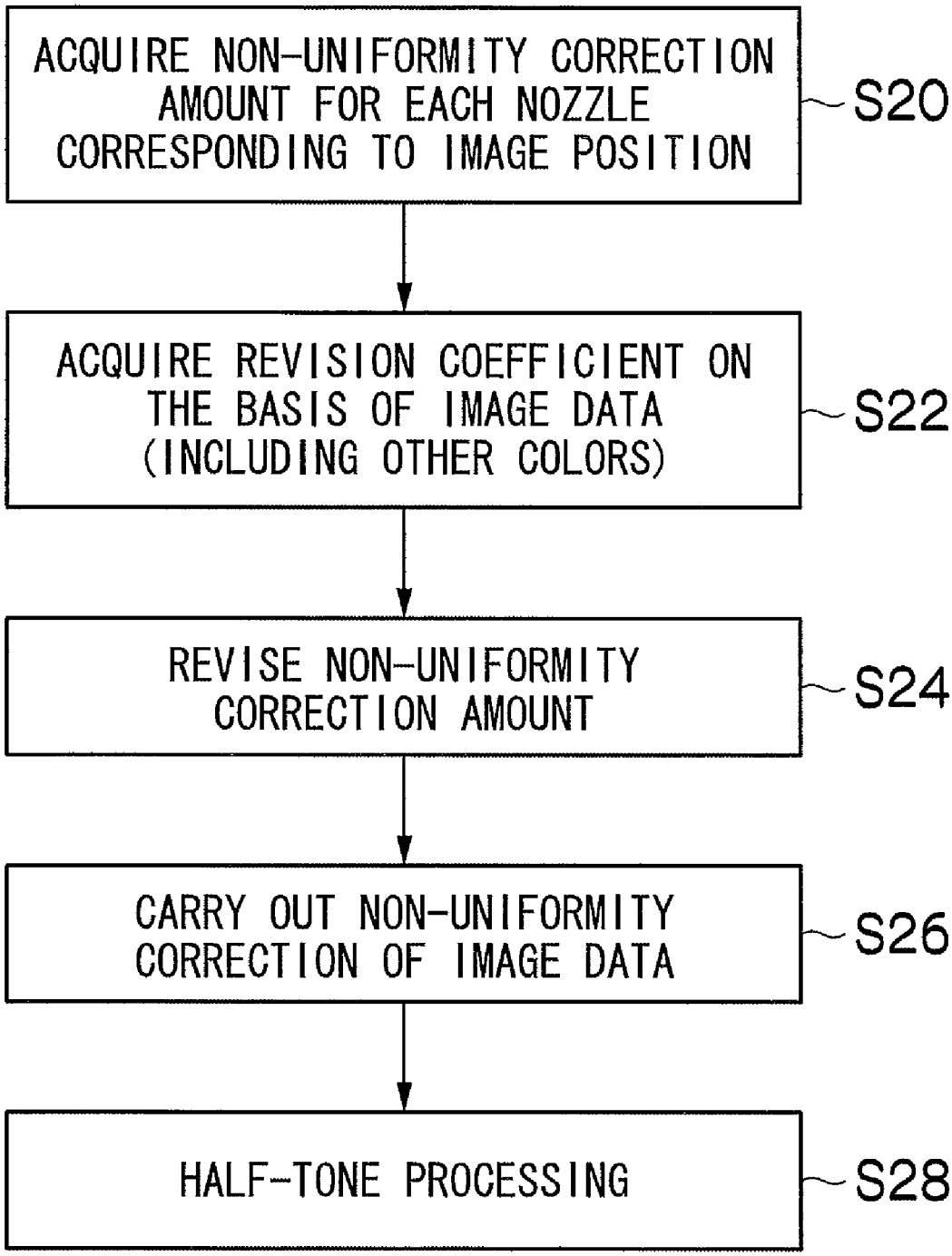
FIG. 16 is a flowchart illustrating the flow of non-uniformity correction processing in the case of an actual print.
Figure 17:
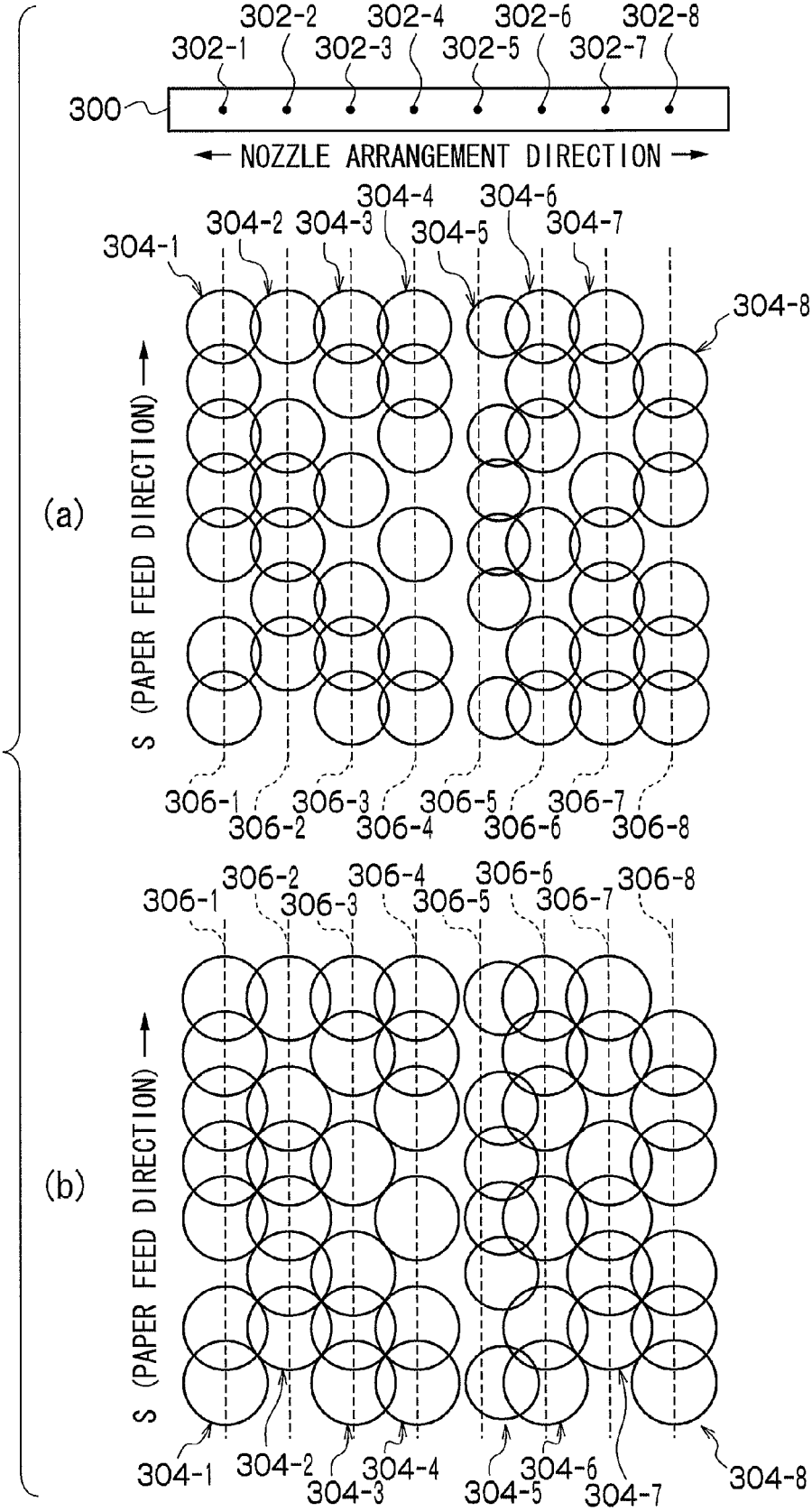
FIG.17 RELATED ART
FIG. 17 is a diagram illustrating a schematic view of an example of density non-uniformities.

FIG. 16 is a flowchart illustrating the flow of non-uniformity correction processing in the case of an actual print.

Firstly, non-uniformity correction amounts for each nozzle are acquired from the non-uniformity correction LUT memory 108 (step S20).

Thereupon, revision coefficients are acquired from the revision coefficient memory 112 on the basis of the image data (CMYK density data) input from the host computer 86 (step S22).

Thereupon, the non-uniformity correction revision unit 110 revises the non-uniformity correction amounts by means of equations (1-1) to (1-4) or equation (3) described above, thereby calculating non-uniformity correction amounts corresponding to the respective coordinate positions of the density data (step S24).

The non-uniformity correction calculation unit 114 then corrects the density data by adding the non-uniformity correction amounts for the respective coordinate positions in the density data (step S26).

Thereupon, the density data is subjected to half-tone processing by the half-tone processing unit 102 and is then output to the print unit 12 (step S28).

According to the present embodiment, if ink droplets (dots) ejected from a plurality of nozzles overlap with each other on recording paper, then it is possible to perform accurate non-uniformity correction by adjusting the extent of the insolubilization or aggregation of subsequently ejected inks by reducing the extent of non-uniformity correction in accordance with the total volume of ink droplets ejected previously.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a treatment liquid deposition device which deposits on a recording medium a treatment liquid that insolubilizes or aggregates an ink;

a recording head having a plurality of nozzles which eject the ink on the recording medium;

a non-uniformity correction amount storage device storing non-uniformity correction amount data which are prepared with respect to each of the plurality of nozzles and determined according to ejection characteristics of each of the plurality of nozzles;

a data acquisition device which acquires density data of an image;

a non-uniformity correction amount revision device which revises the non-uniformity correction amount data for each of the plurality of nozzles, according to the density data related to another nozzle of the plurality of nozzles which ejects the ink that overlaps on the recording medium with the ink ejected by each of the plurality of nozzles, in such a manner that the non-uniformity correction amount data with respect to each of the plurality of nozzles are determined;

a non-uniformity correction device which corrects the density data according to the non-uniformity correction amount data revised by the non-uniformity correction amount revision device; and an image forming device which controls the recording head according to the density data corrected by the non-uniformity correction device in such a manner that the image is formed on the recording medium.

2. The inkjet recording apparatus as defined in claim 1, wherein the treatment liquid deposition device deposits the treatment liquid on the recording medium before the image is formed on the recording medium.

3. The inkjet recording apparatus as defined in claim 1, wherein the image forming device converts the density data corrected by the non-uniformity correction device into dot data for the plurality of nozzles of the recording head, and controls the recording head according to the dot data in such a manner that the image is formed on the recording medium.

4. The inkjet recording apparatus as defined in claim 1, wherein the non-uniformity correction amount revision device revises the non-uniformity correction amount data for a target nozzle of the plurality of nozzles, according to the density data for another nozzle of the plurality of nozzles which performs ink ejection prior to the target nozzle and ejects the ink that overlaps on the recording medium with the ink ejected by the target nozzle.

5. The inkjet recording apparatus as defined in claim 1, comprising a plurality of recording heads, wherein the non-uniformity correction amount revision device revises the non-uniformity correction amount data for a target recording head of the plurality of recording heads, according to the density data for another recording head of the plurality of recording heads which performs ink ejection prior to the target recording head and ejects the ink that overlaps on the recording medium with the ink ejected by the target recording head.

6. The inkjet recording apparatus as defined in claim 5, wherein the non-uniformity correction amount revision device revises the non-uniformity correction amount data in such a manner that an extent of non-uniformity correction of the target recording head becomes less as total volume of the ink ejected by the another recording head becomes greater.

7. The inkjet recording apparatus as defined in claim 5, wherein the non-uniformity correction amount revision device revises the non-uniformity correction amount data in such a manner that an absolute value of a non-uniformity correction amount based on the non-uniformity correction amount data for the target recording head is reduced as total volume of the ink ejected by the another recording head becomes greater.

8. The inkjet recording apparatus as defined in claim 1, comprising:

a test chart output device which causes the image forming device to form a test chart of a single color on the recording medium;

a test chart reading device which reads an image of the test chart on the recording medium; and a non-uniformity correction amount calculation device which determines the ejection characteristics when the ink is ejected by each of the plurality of nozzles, according to the image of the test chart read by the test chart reading device, and determines the non-uniformity correction amount data according to the ejection characteristics.

9. An inkjet recording method comprising the steps of:

depositing a treatment liquid that insolubilizes or aggregates an ink on a recording medium;

acquiring density data of an image;

storing a non-uniformity correction amount data which are stored with respect to each of a plurality of nozzles of a recording head and determined according to ejection characteristics of each of the plurality of nozzles;

revising the non-uniformity correction amount data for each of the plurality of nozzles, according to the density data related to another nozzle of the plurality of nozzles which ejects the ink that overlaps on the recording medium with the ink ejected by each of the plurality of nozzles, in such a manner that the non-uniformity correction amount data with respect to each of the plurality of nozzles are determined;

correcting the density data according to the revised non-uniformity correction amount data; and controlling the recording head according to the corrected density data so as to form an image on the recording medium.

10. The inkjet recording method as defined in claim 9, wherein the treatment liquid is deposited on the recording medium before forming the image on the recording medium.

11. The inkjet recording method as defined in claim 9, wherein the corrected density data is converted into dot data for the plurality of nozzles of the recording head, and the image is formed on the recording medium by controlling the recording head according to the dot data.

12. The inkjet recording method as defined in claim 9, wherein the non-uniformity correction amount data for a target nozzle of the plurality of nozzles are revised according to the density data for another nozzle of the plurality of nozzles which performs ink ejection prior to the target nozzle and ejects the ink that overlaps on the recording medium with the ink ejected by the target nozzle.

13. The inkjet recording method as defined in claim 9, wherein the non-uniformity correction amount data for a target recording head of a plurality of recording heads are revised, according to the density data for another recording head of the plurality of recording heads which performs ink ejection prior to the target recording head and ejects the ink that overlaps on the recording medium with the ink ejected by the target recording head.

14. The inkjet recording method as defined in claim 13, wherein the non-uniformity correction amount data are revised in such a manner that an extent of non-uniformity correction of the target recording head becomes less as total volume of the ink ejected by the another recording head becomes greater.

15. The inkjet recording method as defined in claim 13, wherein the non-uniformity correction amount data are revised in such a manner that an absolute value of a non-uniformity correction amount based on the non-uniformity correction amount data for the target recording head is reduced as total volume of the ink ejected by the another recording head becomes greater.

16. The inkjet recording method as defined in claim 9, wherein:

a test chart of a single color is formed on the recording medium, an image of the test chart on the recording medium is read, and the ejection characteristics when the ink is ejected by each of the plurality of nozzles are determined according to the read image of the test chart, and the non-uniformity correction amount data is calculated according to the ejection characteristics.

* * * * *